US009949039B2

(12) United States Patent
Perkins et al.

(10) Patent No.: US 9,949,039 B2
(45) Date of Patent: Apr. 17, 2018

(54) HEARING SYSTEM HAVING IMPROVED HIGH FREQUENCY RESPONSE

(71) Applicant: EARLENS CORPORATION, Menlo Park, CA (US)

(72) Inventors: Rodney C. Perkins, Woodside, CA (US); Sunil Puria, Sunnyvale, CA (US)

(73) Assignee: Earlens Corporation, Menlo Park, CA (US)

( * ) Notice: Subject to any disclaimer, the term of this patent is extended or adjusted under 35 U.S.C. 154(b) by 0 days.

(21) Appl. No.: 14/843,030

(22) Filed: Sep. 2, 2015

(65) Prior Publication Data

US 2016/0066101 A1 Mar. 3, 2016

Related U.S. Application Data

(63) Continuation of application No. 12/684,073, filed on Jan. 7, 2010, now Pat. No. 9,154,891, which is a continuation of application No. 11/121,517, filed on May 3, 2005, now Pat. No. 7,668,325.

(51) Int. Cl.

| | |
|---|---|
| ***H04R 25/00*** | (2006.01) |
| ***H04R 3/04*** | (2006.01) |
| ***H04R 23/00*** | (2006.01) |

(52) U.S. Cl.

CPC ..... *H04R 25/40* (2013.01); *H04R 3/04* (2013.01); *H04R 25/402* (2013.01); *H04R 25/453* (2013.01); *H04R 25/554* (2013.01); *H04R 25/606* (2013.01); *H04R 23/008* (2013.01); *H04R 2460/09* (2013.01); *H04R 2460/13* (2013.01)

(58) Field of Classification Search

CPC ..... H04R 3/04; H04R 23/008; H04R 25/40; H04R 25/453; H04R 25/554; H04R 25/402; H04R 25/606; H04R 2460/13; H04R 2460/09; H03G 7/00

USPC ..... 181/130, 135; 381/94.2, 320–322, 324, 381/328, 380

See application file for complete search history.

(56) References Cited

U.S. PATENT DOCUMENTS

| | | | | |
|---|---|---|---|---|
| 3,209,082 A | | 9/1965 | McCarrell et al. | |
| 3,229,049 A | * | 1/1966 | Goldberg ..... | H04R 25/356 330/145 |
| 3,440,314 A | | 4/1969 | Eldon | |

(Continued)

FOREIGN PATENT DOCUMENTS

| | | |
|---|---|---|
| AU | 2004301961 A1 | 2/2005 |
| DE | 2044870 A1 | 3/1972 |

(Continued)

OTHER PUBLICATIONS

Fay, et al. Preliminary evaluation of a light-based contact hearing device for the hearing impaired. Otol Neurotol. Jul. 2013;34(5):912-21. doi: 10.1097/MAO.0b013e31827de4b1.

(Continued)

*Primary Examiner* — Jesse A Elbin

(74) *Attorney, Agent, or Firm* — Wilson, Sonsini, Goodrich & Rosati

(57) ABSTRACT

The present invention provides hearing systems and methods that provide an improved high frequency response. The high frequency response improves the signal-to-noise ratio of the hearing system and allows for preservation and transmission of high frequency spatial localization cues.

5 Claims, 7 Drawing Sheets

(56) References Cited

U.S. PATENT DOCUMENTS 3,549,818 A 12/1970 Justin
3,585,416 A 6/1971 Mellen
3,594,514 A 7/1971 Wingrove
3,710,399 A 1/1973 Hurst
3,712,962 A 1/1973 Epley
3,764,748 A 10/1973 Branch et al.
3,808,179 A 4/1974 Gaylord
3,882,285 A 5/1975 Nunley et al.
3,965,430 A 6/1976 Brandt
3,985,977 A 10/1976 Beaty et al.
4,002,897 A 1/1977 Kleinman et al.
4,031,318 A 6/1977 Pitre
4,061,972 A 12/1977 Burgess
4,075,042 A 2/1978 Das
4,098,277 A 7/1978 Mendell
4,109,116 A 8/1978 Victoreen
4,120,570 A 10/1978 Gaylord
4,248,899 A 2/1981 Lyon et al.
4,252,440 A 2/1981 Frosch et al.
4,303,772 A 12/1981 Novicky
4,319,359 A 3/1982 Wolf
4,334,315 A 6/1982 Ono et al.
4,334,321 A 6/1982 Edelman
4,338,929 A 7/1982 Lundin et al.
4,339,954 A 7/1982 Anson et al.
4,357,497 A 11/1982 Hochmair et al.
4,380,689 A 4/1983 Giannetti
4,428,377 A 1/1984 Zollner et al.
4,524,294 A 6/1985 Brody
4,540,761 A 9/1985 Kawamura et al.
4,556,122 A 12/1985 Goode
4,592,087 A 5/1986 Killion et al.
4,606,329 A 8/1986 Hough
4,611,598 A 9/1986 Hortmann et al.
4,628,907 A 12/1986 Epley
4,641,377 A 2/1987 Rush et al.
4,654,554 A 3/1987 Kishi
4,689,819 A 8/1987 Killion
4,696,287 A 9/1987 Hortmann et al.
4,729,366 A 3/1988 Schaefer
4,741,339 A 5/1988 Harrison et al.
4,742,499 A 5/1988 Butler
4,756,312 A 7/1988 Epley
4,759,070 A 7/1988 Voroba et al.
4,766,607 A 8/1988 Feldman
4,774,933 A 10/1988 Hough et al.
4,776,322 A 10/1988 Hough et al.
4,782,818 A 11/1988 Mori
4,800,884 A 1/1989 Heide et al.
4,800,982 A 1/1989 Carlson
4,817,607 A 4/1989 Tatge
4,840,178 A 6/1989 Heide et al.
4,845,755 A 7/1989 Busch et al.
4,865,035 A 9/1989 Mori
4,870,688 A 9/1989 Voroba et al.
4,932,405 A 6/1990 Peeters et al.
4,936,305 A 6/1990 Ashtiani et al.
4,944,301 A 7/1990 Widin et al.
4,948,855 A 8/1990 Novicky
4,957,478 A 9/1990 Maniglia
4,963,963 A 10/1990 Dorman
4,999,819 A 3/1991 Newnham et al.
5,003,608 A 3/1991 Carlson
5,012,520 A 4/1991 Steeger
5,015,224 A 5/1991 Maniglia
5,015,225 A 5/1991 Hough et al.
5,031,219 A 7/1991 Ward et al.
5,061,282 A 10/1991 Jacobs
5,066,091 A 11/1991 Stoy et al.
5,068,902 A 11/1991 Ward
5,094,108 A 3/1992 Kim et al.
5,117,461 A 5/1992 Moseley
5,142,186 A 8/1992 Cross et al.
5,163,957 A 11/1992 Sade et al.
5,167,235 A 12/1992 Seacord et al.
5,201,007 A 4/1993 Ward et al.
5,259,032 A 11/1993 Perkins et al.
5,272,757 A 12/1993 Scofield et al.
5,276,910 A 1/1994 Buchele
5,277,694 A 1/1994 Leysieffer et al.
5,282,858 A 2/1994 Bisch et al.
5,360,388 A 11/1994 Spindel et al.
5,378,933 A 1/1995 Pfannenmueller et al.
5,402,496 A 3/1995 Soli et al.
5,411,467 A 5/1995 Hortmann et al.
5,425,104 A 6/1995 Shennib
5,440,082 A 8/1995 Claes
5,440,237 A 8/1995 Brown et al.
5,455,994 A 10/1995 Termeer et al.
5,456,654 A 10/1995 Ball
5,531,787 A 7/1996 Lesinski et al.
5,531,954 A 7/1996 Heide et al.
5,535,282 A 7/1996 Luca
5,554,096 A 9/1996 Ball
5,558,618 A 9/1996 Maniglia
5,572,594 A 11/1996 Devoe et al.
5,606,621 A 2/1997 Reiter et al.
5,624,376 A 4/1997 Ball et al.
5,654,530 A 8/1997 Sauer et al.
5,692,059 A 11/1997 Kruger
5,699,809 A 12/1997 Combs et al.
5,701,348 A 12/1997 Shennib et al.
5,707,338 A 1/1998 Adams et al.
5,715,321 A 2/1998 Andrea et al.
5,721,783 A 2/1998 Anderson
5,722,411 A 3/1998 Suzuki et al.
5,729,077 A 3/1998 Newnham et al.
5,740,258 A 4/1998 Goodwin-Johansson
5,749,912 A 5/1998 Zhang et al.
5,762,583 A 6/1998 Adams et al.
5,772,575 A 6/1998 Lesinski et al.
5,774,259 A 6/1998 Saitoh et al.
5,782,744 A 7/1998 Money
5,788,711 A 8/1998 Lehner et al.
5,795,287 A 8/1998 Ball et al.
5,797,834 A 8/1998 Goode
5,800,336 A 9/1998 Ball et al.
5,804,109 A 9/1998 Perkins
5,804,907 A 9/1998 Park et al.
5,814,095 A 9/1998 Mueller
5,825,122 A 10/1998 Givargizov et al.
5,836,863 A 11/1998 Bushek et al.
5,842,967 A 12/1998 Kroll
5,857,958 A 1/1999 Ball et al.
5,859,916 A 1/1999 Ball et al.
5,868,682 A 2/1999 Combs et al.
5,879,283 A 3/1999 Adams et al.
5,888,187 A 3/1999 Jaeger et al.
5,897,486 A 4/1999 Ball et al.
5,899,847 A 5/1999 Adams et al.
5,900,274 A 5/1999 Chatterjee et al.
5,906,635 A 5/1999 Maniglia
5,913,815 A 6/1999 Ball et al.
5,922,077 A 7/1999 Espy et al.
5,940,519 A 8/1999 Kuo
5,949,895 A 9/1999 Ball et al.
5,984,859 A 11/1999 Lesinski
5,987,146 A 11/1999 Pluvinage et al.
6,005,955 A 12/1999 Kroll et al.
6,024,717 A 2/2000 Ball et al.
6,045,528 A 4/2000 Arenberg et al.
6,050,933 A 4/2000 Bushek et al.
6,068,589 A 5/2000 Neukermans
6,068,590 A 5/2000 Brisken
6,084,975 A 7/2000 Perkins
6,093,144 A 7/2000 Jaeger et al.
6,135,612 A 10/2000 Clore
6,137,889 A 10/2000 Shennib et al.
6,139,488 A 10/2000 Ball
6,153,966 A 11/2000 Neukermans
6,174,278 B1 1/2001 Jaeger et al.
6,181,801 B1 1/2001 Puthuff et al.
6,190,305 B1 2/2001 Ball et al.
6,190,306 B1 2/2001 Kennedy

(56) References Cited

U.S. PATENT DOCUMENTS 6,208,445 B1 3/2001 Reime
6,217,508 B1 4/2001 Ball et al.
6,222,302 B1 4/2001 Imada et al.
6,222,927 B1 4/2001 Feng et al.
6,240,192 B1 5/2001 Brennan et al.
6,241,767 B1 6/2001 Stennert et al.
6,259,951 B1 7/2001 Kuzma et al.
6,261,224 B1 7/2001 Adams et al.
6,264,603 B1 7/2001 Kennedy
6,277,148 B1 8/2001 Dormer
6,312,959 B1 11/2001 Datskos
6,339,648 B1 1/2002 McIntosh et al.
6,354,990 B1 3/2002 Juneau et al.
6,359,993 B2 3/2002 Brimhall
6,366,863 B1 4/2002 Bye et al.
6,385,363 B1 5/2002 Rajic et al.
6,387,039 B1 5/2002 Moses
6,393,130 B1 5/2002 Stonikas et al.
6,422,991 B1 7/2002 Jaeger
6,432,248 B1 8/2002 Popp et al.
6,436,028 B1 8/2002 Dormer
6,438,244 B1 8/2002 Juneau et al.
6,445,799 B1 9/2002 Taenzer et al.
6,473,512 B1 10/2002 Juneau et al.
6,475,134 B1 11/2002 Ball et al.
6,491,644 B1 12/2002 Vujanic et al.
6,493,453 B1 12/2002 Glendon
6,493,454 B1 12/2002 Loi et al.
6,498,858 B2 12/2002 Kates
6,519,376 B2 2/2003 Biagi et al.
6,536,530 B2 3/2003 Schultz et al.
6,537,200 B2 3/2003 Leysieffer et al.
6,549,633 B1 4/2003 Westermann
6,549,635 B1 4/2003 Gebert
6,554,761 B1 4/2003 Puria et al.
6,575,894 B2 6/2003 Leysieffer et al.
6,592,513 B1 7/2003 Kroll et al.
6,603,860 B1 8/2003 Taenzer et al.
6,620,110 B2 9/2003 Schmid
6,626,822 B1 9/2003 Jaeger et al.
6,629,922 B1 10/2003 Puria et al.
6,631,196 B1 10/2003 Taenzer et al.
6,663,575 B2 12/2003 Leysieffer
6,668,062 B1 12/2003 Luo et al.
6,676,592 B2 1/2004 Ball et al.
6,681,022 B1 1/2004 Puthuff et al.
6,695,943 B2 2/2004 Juneau et al.
6,724,902 B1 4/2004 Shennib et al.
6,726,618 B2 4/2004 Miller
6,726,718 B1 4/2004 Carlyle et al.
6,727,789 B2 4/2004 Tibbetts et al.
6,728,024 B2 4/2004 Ribak
6,735,318 B2 5/2004 Cho
6,754,358 B1 6/2004 Boesen et al.
6,754,359 B1 6/2004 Svean et al.
6,754,537 B1 6/2004 Harrison et al.
6,785,394 B1 8/2004 Olsen et al.
6,801,629 B2 10/2004 Brimhall et al.
6,829,363 B2 12/2004 Sacha
6,837,857 B2 1/2005 Stirnemann
6,842,647 B1 1/2005 Griffith et al.
6,888,949 B1 5/2005 Vanden et al.
6,900,926 B2 5/2005 Ribak
6,912,289 B2 6/2005 Vonlanthen et al.
6,920,340 B2 7/2005 Laderman
6,931,231 B1 8/2005 Griffin
6,940,988 B1 9/2005 Shennib et al.
6,940,989 B1 9/2005 Shennib et al.
D512,979 S 12/2005 Corcoran et al.
6,975,402 B2 12/2005 Bisson et al.
6,978,159 B2 12/2005 Feng et al.
7,043,037 B2 5/2006 Lichtblau et al.
7,050,675 B2 5/2006 Zhou et al.
7,050,876 B1 5/2006 Fu et al.
7,057,256 B2 6/2006 Mazur et al.
7,058,182 B2 6/2006 Kates
7,072,475 B1 7/2006 Denap et al.
7,076,076 B2 7/2006 Bauman
7,095,981 B1 8/2006 Voroba et al.
7,167,572 B1 1/2007 Harrison et al.
7,174,026 B2 2/2007 Niederdrank et al.
7,203,331 B2 4/2007 Boesen
7,239,069 B2 7/2007 Cho
7,245,732 B2 7/2007 Jorgensen et al.
7,255,457 B2 8/2007 Ducharme et al.
7,266,208 B2 9/2007 Charvin et al.
7,289,639 B2 10/2007 Abel et al.
7,313,245 B1 12/2007 Shennib
7,322,930 B2 1/2008 Jaeger et al.
7,349,741 B2 3/2008 Maltan et al.
7,354,792 B2 4/2008 Mazur et al.
7,376,563 B2 5/2008 Leysieffer et al.
7,390,689 B2 6/2008 Mazur et al.
7,394,909 B1 7/2008 Widmer et al.
7,421,087 B2 9/2008 Perkins et al.
7,424,122 B2 9/2008 Ryan
7,444,877 B2 11/2008 Li et al.
7,547,275 B2 6/2009 Cho et al.
7,630,646 B2 12/2009 Anderson et al.
7,668,325 B2 2/2010 Puria et al.
7,747,295 B2 6/2010 Choi
7,826,632 B2 11/2010 Von et al.
7,867,160 B2 1/2011 Pluvinage et al.
8,090,134 B2 1/2012 Takigawa et al.
8,197,461 B1 6/2012 Arenberg et al.
8,233,651 B1 7/2012 Haller
8,295,505 B2 10/2012 Weinans et al.
8,295,523 B2 10/2012 Fay et al.
8,320,601 B2 11/2012 Takigawa et al.
8,340,335 B1 12/2012 Shennib
8,391,527 B2 3/2013 Feucht et al.
8,396,239 B2 3/2013 Fay et al.
8,401,212 B2 3/2013 Puria et al.
8,506,473 B2 8/2013 Puria
8,526,651 B2 9/2013 Van et al.
8,545,383 B2 10/2013 Wenzel et al.
8,600,089 B2 12/2013 Wenzel et al.
8,696,054 B2 4/2014 Crum
8,696,541 B2 4/2014 Pluvinage et al.
8,715,152 B2 5/2014 Puria et al.
8,715,153 B2 5/2014 Puria et al.
8,715,154 B2 5/2014 Perkins et al.
8,761,423 B2 6/2014 Wagner et al.
8,824,715 B2 9/2014 Fay et al.
8,855,323 B2 10/2014 Kroman
8,858,419 B2 10/2014 Puria et al.
8,885,860 B2 11/2014 Djalilian et al.
9,049,528 B2 6/2015 Fay et al.
9,154,891 B2 10/2015 Puria et al.
9,211,069 B2 12/2015 Larsen et al.
9,226,083 B2 12/2015 Puria et al.
9,544,700 B2 1/2017 Puria et al.
2001/0003788 A1 6/2001 Ball et al.
2001/0007050 A1 7/2001 Adelman
2001/0024507 A1 9/2001 Boesen
2001/0027342 A1 10/2001 Dormer
2001/0043708 A1 11/2001 Brimhall
2001/0053871 A1 12/2001 Zilberman et al.
2002/0012438 A1 1/2002 Leysieffer et al.
2002/0029070 A1 3/2002 Leysieffer et al.
2002/0030871 A1 3/2002 Anderson et al.
2002/0035309 A1 3/2002 Leysieffer
2002/0085728 A1 7/2002 Shennib et al.
2002/0086715 A1 7/2002 Sahagen
2002/0172350 A1 11/2002 Edwards et al.
2002/0183587 A1 12/2002 Dormer
2003/0021903 A1 1/2003 Shlenker et al.
2003/0064746 A1 4/2003 Rader et al.
2003/0081803 A1 5/2003 Petilli et al.
2003/0097178 A1 5/2003 Roberson et al.
2003/0125602 A1 7/2003 Sokolich et al.
2003/0142841 A1 7/2003 Wiegand
2003/0208099 A1 11/2003 Ball
2003/0208888 A1 11/2003 Fearing et al.

(56) References Cited

U.S. PATENT DOCUMENTS

| | | | |
|---|---|---|---|
| 2004/0019294 | A1 | 1/2004 | Stirnemann |
| 2004/0165742 | A1 | 8/2004 | Shennib et al. |
| 2004/0166495 | A1 | 8/2004 | Greinwald et al. |
| 2004/0167377 | A1 | 8/2004 | Schafer et al. |
| 2004/0184732 | A1 | 9/2004 | Zhou et al. |
| 2004/0202339 | A1 | 10/2004 | O'Brien et al. |
| 2004/0202340 | A1 | 10/2004 | Armstrong et al. |
| 2004/0208333 | A1 | 10/2004 | Cheung et al. |
| 2004/0234089 | A1 | 11/2004 | Rembrand et al. |
| 2004/0234092 | A1 | 11/2004 | Wada et al. |
| 2004/0236416 | A1 | 11/2004 | Falotico |
| 2004/0240691 | A1 | 12/2004 | Grafenberg |
| 2005/0018859 | A1 | 1/2005 | Buchholz |
| 2005/0020873 | A1 | 1/2005 | Berrang et al. |
| 2005/0036639 | A1 | 2/2005 | Bachler et al. |
| 2005/0038498 | A1 | 2/2005 | Dubrow et al. |
| 2005/0088435 | A1 | 4/2005 | Geng |
| 2005/0101830 | A1 | 5/2005 | Easter et al. |
| 2005/0163333 | A1 | 7/2005 | Abel et al. |
| 2005/0226446 | A1 | 10/2005 | Luo et al. |
| 2005/0271870 | A1 | 12/2005 | Jackson |
| 2006/0023908 | A1 | 2/2006 | Perkins et al. |
| 2006/0058573 | A1 | 3/2006 | Neisz et al. |
| 2006/0062420 | A1 | 3/2006 | Araki |
| 2006/0074159 | A1 | 4/2006 | Lu et al. |
| 2006/0075175 | A1 | 4/2006 | Jensen et al. |
| 2006/0107744 | A1 | 5/2006 | Li et al. |
| 2006/0161255 | A1 | 7/2006 | Zarowski et al. |
| 2006/0177079 | A1 | 8/2006 | Baekgaard et al. |
| 2006/0183965 | A1 | 8/2006 | Kasic et al. |
| 2006/0189841 | A1 | 8/2006 | Pluvinage et al. |
| 2006/0231914 | A1 | 10/2006 | Carey, III |
| 2006/0233398 | A1 | 10/2006 | Husung |
| 2006/0237126 | A1 | 10/2006 | Guffrey et al. |
| 2006/0247735 | A1 | 11/2006 | Honert et al. |
| 2006/0251278 | A1 | 11/2006 | Puria et al. |
| 2006/0278245 | A1 | 12/2006 | Gan |
| 2007/0030990 | A1 | 2/2007 | Fischer |
| 2007/0036377 | A1 | 2/2007 | Stirnemann |
| 2007/0076913 | A1 | 4/2007 | Schanz |
| 2007/0083078 | A1 | 4/2007 | Easter et al. |
| 2007/0100197 | A1 | 5/2007 | Perkins et al. |
| 2007/0127748 | A1 | 6/2007 | Carlile et al. |
| 2007/0127752 | A1 | 6/2007 | Armstrong |
| 2007/0127766 | A1 | 6/2007 | Combest |
| 2007/0135870 | A1 | 6/2007 | Shanks et al. |
| 2007/0161848 | A1 | 7/2007 | Dalton et al. |
| 2007/0191673 | A1 | 8/2007 | Ball et al. |
| 2007/0206825 | A1 | 9/2007 | Thomasson |
| 2007/0225776 | A1 | 9/2007 | Fritsch et al. |
| 2007/0236704 | A1 | 10/2007 | Carr et al. |
| 2007/0250119 | A1 | 10/2007 | Tyler et al. |
| 2007/0251082 | A1 | 11/2007 | Milojevic et al. |
| 2007/0286429 | A1 | 12/2007 | Grafenberg et al. |
| 2008/0021518 | A1 | 1/2008 | Hochmair et al. |
| 2008/0051623 | A1 | 2/2008 | Schneider et al. |
| 2008/0054509 | A1 | 3/2008 | Berman et al. |
| 2008/0063228 | A1 | 3/2008 | Mejia et al. |
| 2008/0063231 | A1 | 3/2008 | Juneau et al. |
| 2008/0089292 | A1 | 4/2008 | Kitazoe et al. |
| 2008/0107292 | A1 | 5/2008 | Kornagel |
| 2008/0123866 | A1 | 5/2008 | Rule et al. |
| 2008/0188707 | A1 | 8/2008 | Bernard et al. |
| 2008/0298600 | A1 | 12/2008 | Poe et al. |
| 2008/0300703 | A1 | 12/2008 | Widmer et al. |
| 2009/0023976 | A1 | 1/2009 | Cho et al. |
| 2009/0043149 | A1 | 2/2009 | Abel et al. |
| 2009/0092271 | A1 | 4/2009 | Fay et al. |
| 2009/0097681 | A1 | 4/2009 | Puria et al. |
| 2009/0141919 | A1 | 6/2009 | Spitaels et al. |
| 2009/0149697 | A1 | 6/2009 | Steinhardt et al. |
| 2009/0253951 | A1 | 10/2009 | Ball et al. |
| 2009/0262966 | A1 | 10/2009 | Vestergaard et al. |
| 2009/0281367 | A1 | 11/2009 | Cho et al. |
| 2009/0310805 | A1 | 12/2009 | Petroff |
| 2010/0034409 | A1 | 2/2010 | Fay et al. |
| 2010/0036488 | A1 | 2/2010 | De, Jr. |
| 2010/0048982 | A1 | 2/2010 | Puria et al. |
| 2010/0085176 | A1 | 4/2010 | Flick |
| 2010/0111315 | A1 | 5/2010 | Kroman |
| 2010/0152527 | A1 | 6/2010 | Puria |
| 2010/0177918 | A1 | 7/2010 | Keady et al. |
| 2010/0202645 | A1 | 8/2010 | Puria et al. |
| 2010/0222639 | A1 | 9/2010 | Purcell et al. |
| 2010/0272299 | A1 | 10/2010 | Van et al. |
| 2010/0290653 | A1 | 11/2010 | Wiggins et al. |
| 2010/0312040 | A1 | 12/2010 | Puria et al. |
| 2011/0069852 | A1 | 3/2011 | Arndt et al. |
| 2011/0077453 | A1 | 3/2011 | Pluvinage et al. |
| 2011/0116666 | A1 | 5/2011 | Dittberner et al. |
| 2011/0152602 | A1 | 6/2011 | Perkins et al. |
| 2011/0182453 | A1 | 7/2011 | Van et al. |
| 2011/0258839 | A1 | 10/2011 | Probst |
| 2012/0008807 | A1 | 1/2012 | Gran |
| 2012/0014546 | A1 | 1/2012 | Puria et al. |
| 2012/0039493 | A1 | 2/2012 | Rucker et al. |
| 2012/0140967 | A1 | 6/2012 | Aubert et al. |
| 2012/0236524 | A1 | 9/2012 | Pugh et al. |
| 2013/0034258 | A1 | 2/2013 | Lin |
| 2013/0083938 | A1 | 4/2013 | Bakalos et al. |
| 2013/0287239 | A1 | 10/2013 | Fay et al. |
| 2013/0308782 | A1 | 11/2013 | Dittberner et al. |
| 2013/0343584 | A1 | 12/2013 | Bennett et al. |
| 2014/0003640 | A1 | 1/2014 | Puria et al. |
| 2014/0056453 | A1 | 2/2014 | Olsen et al. |
| 2014/0153761 | A1 | 6/2014 | Shennib et al. |
| 2014/0169603 | A1 | 6/2014 | Sacha et al. |
| 2014/0254856 | A1 | 9/2014 | Blick et al. |
| 2014/0286514 | A1 | 9/2014 | Pluvinage et al. |
| 2014/0288356 | A1 | 9/2014 | Van |
| 2014/0296620 | A1 | 10/2014 | Puria et al. |
| 2014/0321657 | A1 | 10/2014 | Stirnemann |
| 2014/0379874 | A1 | 12/2014 | Starr et al. |
| 2015/0010185 | A1 | 1/2015 | Puria et al. |
| 2015/0023540 | A1 | 1/2015 | Fay et al. |
| 2015/0031941 | A1 | 1/2015 | Perkins et al. |
| 2015/0201269 | A1 | 7/2015 | Dahl et al. |
| 2015/0222978 | A1 | 8/2015 | Murozaki et al. |
| 2015/0271609 | A1 | 9/2015 | Puria |
| 2016/0029132 | A1 | 1/2016 | Freed et al. |
| 2016/0064814 | A1 | 3/2016 | Jang et al. |
| 2016/0183017 | A1 | 6/2016 | Rucker et al. |
| 2016/0302011 | A1 | 10/2016 | Olsen et al. |
| 2016/0309265 | A1 | 10/2016 | Pluvinage et al. |
| 2016/0309266 | A1 | 10/2016 | Olsen et al. |
| 2017/0095167 | A1 | 4/2017 | Facteau et al. |

FOREIGN PATENT DOCUMENTS

| | | | |
|---|---|---|---|
| DE | 3243850 | A1 | 5/1984 |
| DE | 3508830 | A1 | 9/1986 |
| EP | 0092822 | A2 | 11/1983 |
| EP | 0242038 | A2 | 10/1987 |
| EP | 0291325 | A2 | 11/1988 |
| EP | 0296092 | A2 | 12/1988 |
| EP | 0242038 | A3 | 5/1989 |
| EP | 0296092 | A3 | 8/1989 |
| EP | 0352954 | A2 | 1/1990 |
| EP | 0291325 | A3 | 6/1990 |
| EP | 0352954 | A3 | 8/1991 |
| EP | 1845919 | A1 | 10/2007 |
| EP | 1845919 | B1 | 9/2010 |
| FR | 2455820 | A1 | 11/1980 |
| JP | S60154800 | A | 8/1985 |
| JP | H09327098 | A | 12/1997 |
| JP | 2000504913 | A | 4/2000 |
| JP | 2004187953 | A | 7/2004 |
| KR | 100624445 | B1 | 9/2006 |
| WO | WO-9209181 | A1 | 5/1992 |
| WO | WO-9621334 | A1 | 7/1996 |
| WO | WO-9736457 | A1 | 10/1997 |
| WO | WO-9745074 | A1 | 12/1997 |
| WO | WO-9806236 | A1 | 2/1998 |
| WO | WO-9903146 | A1 | 1/1999 |

(56) References Cited

FOREIGN PATENT DOCUMENTS

| | | | |
|---|---|---|---|
| WO | WO-9915111 | A1 | 4/1999 |
| WO | WO-0022875 | A2 | 4/2000 |
| WO | WO-0022875 | A3 | 7/2000 |
| WO | WO-0150815 | A1 | 7/2001 |
| WO | WO-0158206 | A2 | 8/2001 |
| WO | WO-0176059 | A2 | 10/2001 |
| WO | WO-0158206 | A3 | 2/2002 |
| WO | WO-0239874 | A2 | 5/2002 |
| WO | WO-0239874 | A3 | 2/2003 |
| WO | WO-03063542 | A2 | 7/2003 |
| WO | WO-03063542 | A3 | 1/2004 |
| WO | WO-2004010733 | A1 | 1/2004 |
| WO | WO-2005015952 | A1 | 2/2005 |
| WO | WO-2005107320 | A1 | 11/2005 |
| WO | WO-2006014915 | A2 | 2/2006 |
| WO | WO-2006037156 | A1 | 4/2006 |
| WO | WO-2006042298 | A2 | 4/2006 |
| WO | WO-2006075169 | A1 | 7/2006 |
| WO | WO-2006075175 | A1 | 7/2006 |
| WO | WO-2006042298 | A3 | 12/2006 |
| WO | WO-2009047370 | A2 | 4/2009 |
| WO | WO-2009056167 | A1 | 5/2009 |
| WO | WO-2009047370 | A3 | 7/2009 |
| WO | WO-2009145842 | A2 | 12/2009 |
| WO | WO-2009146151 | A2 | 12/2009 |
| WO | WO-2010033933 | A1 | 3/2010 |
| WO | WO-2012149970 | A1 | 11/2012 |

OTHER PUBLICATIONS

Co-pending U.S. Appl. No. 14/988,304, filed Jan. 5, 2016.
Atasoy [Paper] Opto-acoustic Imaging. for BYM504E Biomedical Imaging Systems class at ITU, downloaded from the Internet www2.itu.edu.td-cilesiz/courses/BYM504- 2005-OA 504041413.pdf, 14 pages.
Athanassiou, et al. Laser controlled photomechanical actuation of photochromic polymers Microsystems. Rev. Adv. Mater. Sci. 2003; 5:245-251.
Ayatollahi, et al. Design and Modeling of Micromachined Condenser MEMS Loudspeaker using Permanent Magnet Neodymium-Iron-Boron (Nd—Fe—B). IEEE International Conference on Semiconductor Electronics, 2006. ICSE '06, Oct. 29, 2006-Dec. 1, 2006; 160-166.
Baer, et al. Effects of Low Pass Filtering on the Intelligibility of Speech in Noise for People With and Without Dead Regions at High Frequencies. J. Acost. Soc. Am 112 (3), pt. 1, (Sep. 2002), pp. 1133-1144.
Best, et al. The influence of high frequencies on speech localization. Abstract 981 (Feb. 24, 2003) from www.aro.org/abstracts/abstracts.html.
Birch, et al. Microengineered systems for the hearing impaired. IEE Colloquium on Medical Applications of Microengineering, Jan. 31, 1996; pp. 2/1-2/5.
Burkhard, et al. Anthropometric Manikin for Acoustic Research. J. Acoust. Soc. Am., vol. 58, No. 1, (Jul. 1975), pp. 214-222.
Camacho-Lopez, et al. Fast Liquid Crystal Elastomer Swims Into the Dark, Electronic Liquid Crystal Communications. Nov. 26, 2003; 9 pages total.
Carlile, et al. Spatialisation of talkers and the segregation of concurrent speech. Abstract 1264 (Feb. 24, 2004) from www.aro.org/abstracts/abstracts.html.
Cheng, et al. A Silicon Microspeaker for Hearing Instruments. Journal of Micromechanics and Microengineering 2004; 14(7):859-866.
Co-pending U.S. Appl. No. 14/554,606, filed Nov. 26, 2014.
Co-pending U.S. Appl. No. 14/813,301, filed Jul. 30, 2015.
Datskos, et al. Photoinduced and thermal stress in silicon microcantilevers. Applied Physics Letters. Oct. 19, 1998; 73(16):2319-2321.
DeCraemer, et al. A method for determining three-dimensional vibration in the ear. Hearing Res., 77:19-37 (1994).
EAR. Retrieved from the Internet: http://wwwmgs.bionet.nsc.ru/mgs/gnw/trrd/thesaurus/Se/ear.html. Accessed Jun. 17, 2008.
European search report and opinion dated Jun. 12, 2009 for EP 06758467.2.
European search report and search opinion dated Sep. 1, 2014 for EP Application No. 14179881.9.
Fay, et al. Cat eardrum response mechanics. Mechanics and Computation Division. Department of Mechanical Engineering. Standford University. 2002; 10 pages total.
Fletcher. Effects of Distortion on the Individual Speech Sounds. Chapter 18, ASA Edition of Speech and Hearing in Communication, Acoust Soc.of Am. (republished in 1995) pp. 415-423.
Freyman, et al. Spatial Release from Informational Masking in Speech Recognition. J. Acost. Soc. Am., vol. 109, No. 5, pt. 1, (May 2001); 2112-2122.
Freyman, et al. The Role of Perceived Spatial Separation in the Unmasking of Speech. J. Acoust. Soc. Am., vol. 106, No. 6, (Dec. 1999); 3578-3588.
Gennum, GA3280 Preliminary Data Sheet: Voyageur TD Open Platform DSP System for Ultra Low Audio Processing, downloaded from the Internet: <<http://www.sounddesigntechnologies.com/products/pdf/37601DOC.pdf>>, Oct. 2006; 17 pages.
Gobin, et al. Comments on the physical basis of the active materials concept. Proc. SPIE 2003; 4512:84-92.
Hato, et al. Three-dimensional stapes footplate motion in human temporal bones. Audiol. Neurootol., 8:140-152 (Jan. 30, 2003).
Hofman, et al. Relearning Sound Localization With New Ears. Nature Neuroscience, vol. 1, No. 5, (Sep. 1998); 417-421.
International search report and written opinion dated Oct. 17, 2007 for PCT/US2006/015087.
Jin, et al. Speech Localization. J. Audio Eng. Soc. convention paper, presented at the AES 112th Convention, Munich, Germany, May 10-13, 2002, 13 pages total.
Killion. Myths About Hearing Noise and Directional Microphones. The Hearing Review. Feb. 2004; 11(2):14, 16, 18, 19, 72 & 73.
Killion. SNR loss: I can hear what people say but I can't understand them. The Hearing Review, 1997; 4(12):8-14.
Lee, et al. A Novel Opto-Electromagnetic Actuator Coupled to the tympanic Membrane. J Biomech. Dec. 5, 2008;41(16):3515-8. Epub Nov. 7, 2008.
Lee, et al. The optimal magnetic force for a novel actuator coupled to the tympanic membrane: a finite element analysis. Biomedical engineering: applications, basis and communications. 2007; 19(3):171-177.
Lezal. Chalcogenide glasses—survey and progress. Journal of Optoelectronics and Advanced Materials. Mar. 2003; 5(1):23-34.
Martin, et al. Utility of Monaural Spectral Cues is Enhanced in the Presence of Cues to Sound-Source Lateral Angle. JARO. 2004; 5:80-89.
Moore. Loudness perception and intensity resolution. Cochlear Hearing Loss, Chapter 4, pp. 90-115, Whurr Publishers Ltd., London (1998).
Murugasu, et al. Malleus-to-footplate versus malleus-to-stapes-head ossicular reconstruction prostheses: temporal bone pressure gain measurements and clinical audiological data. Otol Neurotol. Jul. 2005; 2694):572-582.
Musicant, et al. Direction-Dependent Spectral Properties of Cat External Ear: New Data and Cross-Species Comparisons. J. Acostic. Soc. Am, May 10-13, 2002, vol. 87, No. 2, (Feb. 1990), pp. 757-781.
National Semiconductor, LM4673 Boomer: Filterless, 2.65W, Mono, Class D Audio Power Amplifier, [Data Sheet] downloaded from the Internet: <<http://www.national.com/ds/LM/LM4673.pdf>>; Nov. 1, 2007; 24 pages.
"Notice of allowance dated Jun. 3, 2015 for U.S. Appl. No. 12/684,073.".
"Notice of allowance dated Dec. 1, 2009 for U.S. Appl. No. 11/121,517.".
O'Connor, et al. Middle ear Cavity and Ear Canal Pressure-Driven Stapes Velocity Responses in Human Cadaveric Temporal Bones. J Acoust Soc Am. Sep. 2006; 120(3): 1517-28.
Office action dated Jan. 22, 2008 for U.S. Appl. No. 11/121,517.
Office action dated Mar. 15, 2012 for U.S. Appl. No. 12/684,073.

(56) References Cited

OTHER PUBLICATIONS

Office action dated Mar. 17, 2009 for U.S. Appl. No. 11/121,517.
"Office action dated Jun. 16, 2014 for U.S. Appl. No. 12/684,073 .".
Office action dated Jul. 21, 2009 for U.S. Appl. No. 11/121,517.
Office action dated Aug. 5, 2008 for U.S. Appl. No. 11/121,517.
Office action dated Nov. 14, 2012 for U.S. Appl. No. 12/684,073.
Office action dated Nov. 14, 2014 for U.S. Appl. No. 12/684,073.
Office action dated Nov. 22, 2013 for U.S. Appl. No. 12/684,073.
Poosanaas, et al. Influence of sample thickness on the performance of photostrictive ceramics, J. App. Phys. Aug. 1, 1998; 84(3):1508-1512.
Puria et al. A gear in the middle ear. ARO Denver CO, 2007b.
Puria, et al. Malleus-to-footplate ossicular reconstruction prosthesis positioning: cochleovestibular pressure optimization. Otol Nerotol. May 2005; 2693):368-379.
Puria, et al. Measurements and model of the cat middle ear: Evidence of tympanic membrane acoustic delay. J. Acoust. Soc. Am., 104(6):3463-3481 (Dec. 1998).
Puria, et al. Middle Ear Morphometry From Cadaveric Temporal Bone MicroCT Imaging. Proceedings of the 4th International Symposium, Zurich, Switzerland, Jul. 27-30, 2006, Middle Ear Mechanics in Research and Otology, pp. 259-268.
Puria, et al. Sound-Pressure Measurements in the Cochlear Vestibule of Human-Cadaver Ears. Journal of the Acoustical Society of America. 1997; 101 (5-1): 2754-2770.
Puria, et al. Tympanic-membrane and malleus-incus-complex co-adaptations for high-frequency hearing in mammals. Hear Res. May 2010;263(1-2):183-90. doi: 10.1016/j.heares.2009.10.013. Epub Oct. 28, 2009.
Sekaric, et al. Nanomechanical resonant structures as tunable passive modulators. App. Phys. Lett. Nov. 2003; 80(19):3617-3619.
Shaw. Transformation of Sound Pressure Level From the Free Field to the Eardrum in the Horizontal Plane. J. Acoust. Soc. Am., vol. 56, No. 6, (Dec. 1974), 1848- 1861.
Shih. Shape and displacement control of beams with various boundary conditions via photostrictive optical actuators. Proc. IMECE. Nov. 2003; 1-10.
Sound Design Technologies, —Voyager TDTM Open Platform DSP System for Ultra Low Power Audio Processing—GA3280 Data Sheet. Oct. 2007; retrieved from the Internet: <<http://www.sounddes.com/pdf/37601DOC.pdf%gt;>, 15 page total.
Stuchlik, et al. Micro-Nano Actuators Driven by Polarized Light. IEEE Proc. Sci. Meas. Techn. Mar. 2004; 151(2):131-136.
Suski, et al. Optically activated ZnO/Si02/Si cantilever beams. Sensors and Actuators A (Physical), 0 (nr: 24). 2003; 221-225.
Takagi, et al. Mechanochemical Synthesis of Piezoelectric PLZT Powder. KONA. 2003; 51(21):234-241.
Thakoor, et al. Optical microactuation in piezoceramics. Proc. SPIE. Jul. 1998; 3328:376-391.
Thompson. Tutorial on microphone technologies for directional hearing aids. Hearing Journal. Nov. 2003; 56(11):14-16,18, 20-21.
Tzou, et al. Smart Materials, Precision Sensors/Actuators, Smart Structures, and Structronic Systems. Mechanics of Advanced Materials and Structures. 2004; 11:367-393.
Uchino, et al. Photostricitve actuators. Ferroelectrics. 2001; 258:147-158.
U.S. Appl. No. 61/073,271, filed Jun. 17, 2008.
U.S. Appl. No. 61/073,281, filed Jun. 17, 2008.
Vickers, et al. Effects of Low-Pass Filtering on the Intelligibility of Speech in Quiet for People With and Without Dead Regions at High Frequencies. J. Acoust. Soc. Am. Aug. 2001; 110(2):1164-1175.
Wang, et al. Preliminary Assessment of Remote Photoelectric Excitation of an Actuator for a Hearing Implant. Proceeding of the 2005 IEEE, Engineering in Medicine and Biology 27th nnual Conference, Shanghai, China. Sep. 1-4, 2005; 6233-6234.
Wiener, et al. On the Sound Pressure Transformation by the Head and Auditory Meatus of the Cat. Acta Otolaryngol. Mar. 1966; 61(3):255-269.
Wightman, et al. Monaural Sound Localization Revisited. J Acoust Soc Am. Feb. 1997;101(2):1050-1063.
Yi, et al. Piezoelectric Microspeaker with Compressive Nitride Diaphragm. The Fifteenth IEEE International Conference on Micro Electro Mechanical Systems, 2002; 260-263.
Yu, et al. Photomechanics: Directed bending of a polymer film by light. Nature. Sep. 2003; 425:145.
Jian, et al. A 0.6 V, 1.66 mW energy harvester and audio driver for tympanic membrane transducer with wirelessly optical signal and power transfer. InCircuits and Systems (ISCAS), 2014 IEEE International Symposium on Jun. 1, 2014. 874-7. IEEE.
Song, et al. The development of a non-surgical direct drive hearing device with a wireless actuator coupled to the tympanic membrane. Applied Acoustics. Dec. 31, 2013;74(12):1511-8.
Carlile, et al. Frequency bandwidth and multi-talker environments. Audio Engineering Society Convention 120. Audio Engineering Society, May 20-23, 2006. Paris, France. 118: 8 pages.
Co-pending U.S. Appl. No. 14/949,495, filed Nov. 23, 2015.
Killion, et al. The case of the missing dots: AI and SNR loss. The Hearing Journal, 1998. 51(5), 32-47.
Moore, et al. Perceived naturalness of spectrally distorted speech and music. J Acoust Soc Am. Jul. 2003;114(1):408-19.
Puria. Measurements of human middle ear forward and reverse acoustics: implications for otoacoustic emissions. J Acoust Soc Am. May 2003;113(5):2773-89.
Asbeck, et al. Scaling Hard Vertical Surfaces with Compliant Microspine Arrays, The International Journal of Robotics Research 2006; 25; 1165-79.
Autumn, et al. Dynamics of geckos running vertically, The Journal of Experimental Biology 209, 260-272, (2006).
Autumn, et al., Evidence for van der Waals adhesion in gecko setae, www.pnas.orgycgiydoiy10.1073ypnas.192252799 (2002).
Boedts. Tympanic epithelial migration, Clinical Otolaryngology 1978, 3, 249-253.
Cheng; et al., "A silicon microspeaker for hearing instruments. Journal of Micromechanics and Microengineering 14, No. 7 (2004): 859-866.".
Fay. Cat eardrum mechanics. Ph.D. thesis. Disseration submitted to Department of Aeronautics and Astronautics. Standford University. May 2001; 210 pages total.
Fay, et al. The discordant eardrum, PNAS, Dec. 26, 2006, vol. 103, No. 52, p. 19743-19748.
Ge, et al., Carbon nanotube-based synthetic gecko tapes, p. 10792-10795, PNAS, Jun. 26, 2007, vol. 104, No. 26.
Gorb, et al. Structural Design and Biomechanics of Friction-Based Releasable Attachment Devices in Insects, Integr. Comp_Biol., 42:1127-1139 (2002).
Headphones. Wikipedia Entry. Downloaded from the Internet. Accessed Oct. 27, 2008. 7 pages. URL: http://en.wikipedia.org/wiki/Headphones>.
Izzo, et al. Laser Stimulation of Auditory Neurons: Effect of Shorter Pulse Duration and Penetration Depth. Biophys J. Apr. 15, 2008;94(8):3159-3166.
Izzo, et al. Laser Stimulation of the Auditory Nerve. Lasers Surg Med. Sep. 2006;38(8):745-753.
Izzo, et al. Selectivity of Neural Stimulation in the Auditory System: A Comparison of Optic and Electric Stimuli. J Biomed Opt. Mar.-Apr. 2007;12(2):021008.
Makino, et al. Epithelial migration in the healing process of tympanic membrane perforations. Eur Arch Otorhinolaryngol. 1990; 247: 352-355.
Makino, et al., Epithelial migration on the tympanic membrane and external canal, Arch Otorhinolaryngol (1986) 243:39-42.
Markoff. Intuition + Money: An Aha Moment. New York Times Oct. 11, 2008, p. BU4, 3 pages total.
Michaels, et al., Auditory Epithelial Migration on the Human Tympanic Membrane: II. The Existence of Two Discrete Migratory Pathways and Their Embryologic Correlates, The American Journal of Anatomy 189:189-200 (1990).
Murphy M, Aksak B, Sitti M. Adhesion and anisotropic friction enhancements of angled heterogeneous micro-fiber arrays with spherical and spatula tips. J Adhesion Sci Technol, vol. 21, No. 12-13, p. 1281-1296, 2007.
Nishihara, et al. Effect of changes in mass on middle ear function. Otolaryngol Head Neck Surg. Nov. 1993;109(5):889-910.

(56) References Cited

OTHER PUBLICATIONS

Puria, et al., Mechano-Acoustical Transformations in A. Basbaum et al., eds., The Senses: A Comprehensive Reference, v3, p. 165-202, Academic Press (2008).
Qu, et al. Carbon Nanotube Arrays with Strong Shear Binding-On and Easy Normal Lifting-Off, Oct. 10, 2008 vol. 322 Science. 238-242.
Roush. SiOnyx Brings "Black Silicon" into the Light; Material Could Upend Solar, Imaging Industries. Xconomy, Oct. 12, 2008, retrieved from the Internet: www.xconomy.com/boston/2008/10/12/sionyx-brings-black-silicon-into-the-light-material-could-upend-solar-imaging-industries> 4 pages total.
R.P. Jackson, C. Chlebicki, T.B. Krasieva, R. Zalpuri, W.J. Triffo, S. Puria. Multiphoton and Transmission Electron Microscopy of Collagen in Ex Vivo Tympanic Membranes. Biomedcal Computation at STandford, Oct. 2008.
Rubinstein. How Cochlear Implants Encode Speech. Curr Opin Otolaryngol Head Neck Surg. Oct. 2004;12(5):444-8; retrieved from the Internet: www.ohsu.edu/nod/documents/week3/Rubenstein.pdf.
Spolenak, et al. Effects of contact shape on the scaling of biological attachments. Proc. R. Soc. A. 2005; 461:305-319.
Stenfelt, et al. Bone-Conducted Sound: Physiological and Clinical Aspects. Otology & Neurotology, Nov. 2005; 26 (6):1245-1261.
The Scientist and Engineers Guide to Digital Signal Processing, copyright 01997-1998 by Steven W. Smith, available online at www.DSPguide.com.
Vinikman-Pinhasi, et al. Piezoelectric and Piezooptic Effects in Porous Silicon. Applied Physics Letters, Mar. 2006; 88(11): 11905-111906.
Yao, et al. Adhesion and sliding response of a biologically inspired fibrillar surface: experimental observations, J. R. Soc. Interface (2008) 5, 723-733 doi:10.1098/rsif.2007.1225 Published online Oct. 30, 2007.
Yao, et al. Maximum strength for intermolecular adhesion of nanospheres at an optimal size. J. R. Soc. Interface doi:10.10981rsif.2008.0066 Published online 2008.
Khaleghi, et al. Attenuating the ear canal feedback pressure of a laser-driven hearing aid. J Acoust Soc Am. Mar. 2017;141(3):1683.
Struck, et al. Comparison of Real-world Bandwidth in Hearing Aids vs Earlens Light-driven Hearing Aid System. The Hearing Review. TechTopic: EarLens. Hearingreview.com. Mar. 14, 2017. pp. 24-28.
Fritsch, et al. EarLens transducer behavior in high-field strength MRI scanners. Otolaryngol Head Neck Surg. Mar. 2009;140(3):426-8. doi: 10.1016/j.otohns.2008.10.016.
Gantz, et al. Broad Spectrum Amplification with a Light Driven Hearing System. Combined Otolaryngology Spring Meetings, 2016 (Chicago).
Gantz, et al. Light Driven Hearing Aid: A Multi-Center Clinical Study. Association for Research in Otolaryngology Annual Meeting, 2016 (San Diego).
Gantz, et al. Light-Driven Contact Hearing Aid for Broad Spectrum Amplification: Safety and Effectiveness Pivotal Study. Otology & Neurotology Journal, 2016 (in review).
Gantz, et al. Light-Driven Contact Hearing Aid for Broad-Spectrum Amplification: Safety and Effectiveness Pivotal Study. Otology & Neurotology. Copyright 2016. 7 pages.
Khaleghi, et al. Characterization of Ear-Canal Feedback Pressure due to Umbo-Drive Forces: Finite-Element vs. Circuit Models. ARO Midwinter Meeting 2016, (San Diego).
Levy, et al. Characterization of the available feedback gain margin at two device microphone locations, in the fossa triangularis and Behind the Ear, for the light-based contact hearing device. Acoustical Society of America (ASA) meeting, 2013 (San Francisco).
Levy, et al. Extended High-Frequency Bandwidth Improves Speech Reception in the Presence of Spatially Separated Masking Speech. Ear Hear. Sep.-Oct. 2015;36(5):e214-24. doi: 10.1097/AUD.0000000000000161.
Moore, et al. Spectro-temporal characteristics of speech at high frequencies, and the potential for restoration of audibility to people with mild-to-moderate hearing loss. Ear Hear. Dec. 2008;29(6):907-22. doi: 10.1097/AUD.0b013e31818246f6.
Perkins, et al. Light-based Contact Hearing Device: Characterization of available Feedback Gain Margin at two device microphone locations. Presented at AAO-HNSF Annual Meeting, 2013 (Vancouver).
Perkins, et al. The EarLens Photonic Transducer: Extended bandwidth. Presented at AAO-HNSF Annual Meeting, 2011 (San Francisco).
Perkins, et al. The EarLens System: New sound transduction methods. Hear Res. Feb. 2, 2010; 10 pages total.
Perkins, R. Earlens tympanic contact transducer: a new method of sound transduction to the human ear. Otolaryngol Head Neck Surg. Jun. 1996;114(6):720-8.
Puria, et al. Cues above 4 kilohertz can improve spatially separated speech recognition. The Journal of the Acoustical Society of America, 2011, 129, 2384.
Puria, et al. Extending bandwidth above 4 kHz improves speech understanding in the presence of masking speech. Association for Research in Otolaryngology Annual Meeting, 2012 (San Diego).
Puria, et al. Extending bandwidth provides the brain what it needs to improve hearing in noise. First international conference on cognitive hearing science for communication, 2011 (Linkoping, Sweden).
Puria, et al. Hearing Restoration: Improved Multi-talker Speech Understanding. 5th International Symposium on Middle Ear Mechanics in Research and Otology (MEMRO), Jun. 2009 (Stanford University).
Puria, et al. Imaging, Physiology and Biomechanics of the middle ear: Towards understating the functional consequences of anatomy. Stanford Mechanics and Computation Symposium, 2005, ed Fong J.
Puria, et al. Temporal-Bone Measurements of the Maximum Equivalent Pressure Output and Maximum Stable Gain of a Light-Driven Hearing System That Mechanically Stimulates the Umbo. Otol Neurotol. Feb. 2016;37(2):160-6. doi: 10.1097/MAO.0000000000000941.
Puria, et al. The EarLens Photonic Hearing Aid. Association for Research in Otolaryngology Annual Meeting, 2012 (San Diego).
Puria, et al. The Effects of bandwidth and microphone location on understanding of masked speech by normal-hearing and hearing-impaired listeners. International Conference for Hearing Aid Research (IHCON) meeting, 2012 (Tahoe City).
Puria, S. Middle Ear Hearing Devices. Chapter 10. Part of the series Springer Handbook of Auditory Research pp. 273-308. Date: Feb. 9, 2013.

* cited by examiner

HEARING SYSTEM HAVING IMPROVED HIGH FREQUENCY RESPONSE

CROSS-REFERENCES TO RELATED APPLICATIONS

The present application is a continuation of U.S. patent application Ser. No. 12/684,073, filed Jan. 7, 2010, which is a continuation of U.S. patent application Ser. No. 11/121,517, filed on May 3, 2005, now U.S. Pat. No. 7,668,325, issued on Feb. 23, 2010, the full disclosures of which are incorporated herein by reference.

BACKGROUND OF THE INVENTION

Field of the Invention

The present invention relates to hearing methods and systems. More specifically, the present invention relates to methods and systems that have improved high frequency response that improves the speech reception threshold (SRT) and preserves and transmits high frequency spatial localization cues to the middle or inner ear. Such systems may be used to enhance the hearing process with normal or impaired hearing.

Previous studies have shown that when the bandwidth of speech is low pass filtered, that speech intelligibility does not improve for bandwidths above about 3 kHz (Fletcher 1995), which is the reason why the telephone system was designed with a bandwidth limit to about 3.5 kHz, and also why hearing aid bandwidths are limited to frequencies below about 5.7 kHz (Killion 2004). It is now evident that there is significant energy in speech above about 5 kHz (Jin et al., *J. Audio Eng. Soc.*, Munich 2002). Furthermore, hearing impaired subjects, with amplified speech, perform better with increased bandwidth in quiet (Vickers et al. 2001) and in noisy situations (Baer et al. 2002). This is especially true in subjects that do not have dead regions in the cochlea at the high frequencies (Moore, "Loudness perception and intensity resolution," Cochlear Hearing Loss, Chapter 4, pp. 90-115, Whurr Publishers Ltd., London 1998). Thus, subjects with hearing aids having greater bandwidth than the existing 5.7 kHz bandwidths can be expected to have improved performance in quiet and in diffuse-field noisy conditions.

Numerous studies, both in humans (Shaw 1974) and in cats (Musicant et al. 1990) have shown that sound pressure at the ear canal entrance varies with the location of the sound source for frequencies above 5 kHz. This spatial filtering is due to the diffraction of the incoming sound wave by the pinna. It is well established that these diffraction cues help in the perception of spatial localization (Best et al., "The influence of high frequencies on speech localization," Abstract 981 (Feb. 24, 2003) from <www.aro.org/abstracts/abstracts.html>). Due to the limited bandwidth of conventional hearing aids, some of the spatial localization cues are removed from the signal that is delivered to the middle and/or inner ear. Thus, it is oftentimes not possible for wearers of conventional hearing aids to accurately externalize talkers, which requires speech energy above 5 kHz.

The eardrum to ear canal entrance pressure ratio has a 10 dB resonance at about 3.5 kHz (Wiener et al. 1966; Shaw 1974). This is independent of the sound source location in the horizontal plane (Burkhard and Sachs 1975). This ratio is a function of the dimensions and consequent relative acoustic impedance of the eardrum and the ear canal. Thus, once the diffracted sound wave propagates past the entrance of the ear canal, there is no further spatial filtering. In other words, for spatial localization, there is no advantage to placing the microphone any more medial than near the entrance of the car canal. The 10 dB resonance is typically added in most hearing aids after the microphone input because this gain is not spatially dependent.

Evidence is now growing that the perception of the differences in the spatial locations of multiple talkers aid in the segregation of concurrent speech (Freyman et al. 1999; Freyman et al. 2001). Consistent with other studies, Carlile et al., "Spatialisation of talkers and the segregation of concurrent speech," Abstract 1264 (Feb. 24, 2004) from <www.aro.org/abstracts/abstracts.html>, showed a speech reception threshold (SRT) of −4 dB under diotic conditions, where speech and masker noise at the two ears are the same, and −20 dB with speech maskers spatially separated by 30 degrees. But when the speech signal was low pass filtered to 5 kHz, the SRT decreased to −15 dB. While previous single channel studies have indicated that information in speech above 5 kHz does not contribute to speech intelligibility, these data indicate that as much as 5 dB unmasking afforded by externalization percept was much reduced when compared to the wide bandwidth presentation over virtual auditory simulations. The 5 dB improvement in SRT is mostly due to central mechanisms. However, at this point, it is not clear how much of the 5 dB improvement can be attained with auditory cues through a single channel (e.g., one ear).

It has recently been described in P. M. Holman et al., "Relearning sound localization with new ears," *Nature Neuroscience*, vol. 1, no. 5, September 1998, that sound localization relies on the neural processing of implicit acoustic cues. Hofman et al. found that accurate localization on the basis of spectral cues poses constraints on the sound spectrum, and that a sound needs to be broad-band in order to yield sufficient spectral shape information. However, with conventional hearing systems, because the ear canal is often completely blocked and because conventional hearing systems often have a low bandwidth filter, such conventional systems will not allow the user to receive the three-dimensional localization spatial cues.

Furthermore, Wightman and Kistler (1997) found that listeners do not localize virtual sources of sound when sound is presented to only one ear. This suggests that high-frequency spectral cues presented to one ear through a hearing device may not be beneficial. Martin et al. (2004) recently showed that when the signal to one ear is low-pass filtered (2.5 kHz), thus preserving binaural information regarding sound-source lateral angle, monaural spectral cues to the opposite car could correctly interpret elevation and front-back hemi-field cues. This says that a subject with one wide-band hearing aid can localize sounds with that hearing aid, provided that the opposite ear does not have significant low-frequency hearing loss, and thus able to process interaural time difference cues. The improvement in unmasking due to externalization observed by Carlile et al. (2004) should at least be possible with monaural amplification. The open question is how much of the 5 dB improvement in SRT can be realized monaurally and with a device that partially blocks the auditory ear canal.

Head related transfer functions (HRTFs) are due to the diffraction of the incoming sound wave by the pinna. Another factor that determines the measured HRTF is the opening of the ear canal itself. It is conceivable that a device in the ear canal that partially blocks it and thus will alter HRTFs, can eliminate directionally dependent pinna cues. Burkhard and Sachs (1975) have shown that when the canal is blocked, spatially dependent vertical localization cues are modified but nevertheless present. Some relearning of the new cues may be required to obtain benefit from the high frequency cues. Hoffman et al. (1998) showed that this learning takes place over a period of less than 45 days.

Presently, most conventional hearing systems fall into at least three categories: acoustic hearing systems, electromagnetic drive hearing systems, and cochlear implants. Acoustic hearing systems rely on acoustic transducers that produce amplified sound waves which, in turn, impart vibrations to the tympanic membrane or eardrum. The telephone earpiece, radio, television and aids for the hearing impaired are all examples of systems that employ acoustic drive mechanisms. The telephone earpiece, for instance, converts signals transmitted on a wire into vibrational energy in a speaker which generates acoustic energy. This acoustic energy propagates in the ear canal and vibrates the tympanic membrane. These vibrations, at varying frequencies and amplitudes, result in the perception of sound. Surgically implanted cochlear implants electrically stimulate the auditory nerve ganglion cells or dendrites in subjects having profound hearing loss.

Hearing systems that deliver audio information to the ear through electromagnetic transducers are well known. These transducers convert electromagnetic fields, modulated to contain audio information, into vibrations which are imparted to the tympanic membrane or parts of the middle ear. The transducer, typically a magnet, is subjected to displacement by electromagnetic fields to impart vibrational motion to the portion to which it is attached, thus producing sound perception by the wearer of such an electromagnetically driven system. This method of sound perception possesses some advantages over acoustic drive systems in terms of quality, efficiency, and most importantly, significant reduction of "feedback," a problem common to acoustic hearing systems.

Feedback in acoustic hearing systems occurs when a portion of the acoustic output energy returns or "feeds back" to the input transducer (microphone), thus causing self-sustained oscillation. The potential for feedback is generally proportional to the amplification level of the system and, therefore, the output gain of many acoustic drive systems has to be reduced to less than a desirable level to prevent a feedback situation. This problem, which results in output gain inadequate to compensate for hearing losses in particularly severe cases, continues to be a major problem with acoustic type hearing aids. To minimize the feedback to the microphone, many acoustic hearing devices close off, or provide minimal venting, to the ear canal. Although feedback may be reduced, the tradeoff is "occlusion," a tunnel-like hearing sensation that is problematic to most hearing aid users. Directly driving the eardrum can minimize the feedback because the drive mechanism is mechanical rather than acoustic. Because of the mechanically vibrating eardrum, sound is coupled to the ear canal and wave propagation is supported in the reverse direction. The mechanical to acoustic coupling, however, is not efficient and this inefficiency is exploited in terms of decreased sound in the ear canal resulting in increased system gain.

One system, which non-invasively couples a magnet to tympanic membrane and solves some of the aforementioned problems, is disclosed by Perkins et al. in U.S. Pat. No. 5,259,032, which is hereby incorporated by reference. The Perkins patent discloses a device for producing electromagnetic signals having a transducer assembly which is weakly but sufficiently affixed to the tympanic membrane of the wearer by surface adhesion. U.S. Pat. No. 5,425,104, also incorporated herein by reference, discloses a device for producing electromagnetic signals incorporating a drive means external to the acoustic canal of the individual. However, because magnetic fields decrease in strength as the reciprocal of the square of the distance ($1/R^2$), previous methods for generating audio carrying magnetic fields are highly inefficient and are thus not practical.

While the conventional hearing aids have been relatively successful at improving hearing, the conventional hearing aids have not been able to significantly improve preservation of high-frequency spatial localization cues. For these reasons it would be desirable to provide an improved hearing systems.

Description of the Background Art

U.S. Pat. Nos. 5,259,032 and 5,425,104 have been described above. Other patents of interest include: U.S. Pat. Nos. 5,015,225; 5,276,910; 5,456,654; 5,797,834; 6,084,975; 6,137,889; 6,277,148; 6,339,648; 6,354,990; 6,366,863; 6,387,039; 6,432,248; 6,436,028; 6,438,244; 6,473,512; 6,475,134; 6,592,513; 6,603,860; 6,629,922; 6,676,592; and 6,695,943. Other publications of interest include: U.S. Patent Publication Nos. 2002-0183587, 2001-0027342; Journal publications Decraemer et al., "A method for determining three-dimensional vibration in the ear," *Hearing Res.,* 77:19-37 (1994); Puria et al., "Sound-pressure measurements in the cochlear vestibule of human cadaver ears," *J. Acoust. Soc. Am.,* 101(5):2754-2770 (May 1997); Moore, "Loudness perception and intensity resolution," *Cochlear Hearing Loss, Chapter* 4, pp. 90-115, Whurr Publishers Ltd., London (1998); Puria and Allen "Measurements and model of the cat middle ear: Evidence of tympanic membrane acoustic delay," *J. Acoust. Soc. Am.,* 104(6):3463-3481 (December 1998); Hoffman et al. (1998); Fay et al., "Cat eardrum response mechanics," Calladine Festschrift (2002), Ed. S. Pellegrino, The Netherlands, Kluwer Academic Publishers; and Hato et al., "Three-dimensional stapes footplate motion in human temporal bones," *Audiol. Neurootol.,* 8:140-152 (Jan. 30, 2003). Conference presentation abstracts: Best et al., "The influence of high frequencies on speech localization," Abstract 981 (Feb. 24, 2003) from <www.aro.org/abstracts/abstracts.html>, and Carlile et al., "Spatialisation of talkers and the segregation of concurrent speech," Abstract 1264 (Feb. 24, 2004) from <www.aro.org/abstracts/abstracts.html>.

BRIEF SUMMARY OF THE INVENTION

The present invention provides hearing system and methods that have an improved high frequency response that improves the speech reception threshold and preserves high frequency spatial localization cues to the middle or inner car.

The hearing systems constructed in accordance with the principles of the present invention generally comprise an input transducer assembly, a transmitter assembly, and an output transducer assembly. The input transducer assembly will receive a sound input, typically either ambient sound (in the case of hearing aids for hearing impaired individuals) or an electronic sound signal from a sound producing or receiving device, such as the telephone, a cellular telephone, a radio, a digital audio unit, or any one of a wide variety of other telecommunication and/or entertainment devices. The input transducer assembly will send a signal to the transmitter assembly where the transmitter assembly processes the signal from the transducer assembly to produce a processed signal which is modulated in some way, to represent or encode a sound signal which substantially represents the sound input received by the input transducer assembly. The exact nature of the processed output signal will be selected to be used by the output transducer assembly to provide both the power and the signal so that the output transducer assembly can produce mechanical vibrations, acoustical output, pressure output, (or other output) which, when properly coupled to a subject's hearing transduction pathway, will induce neural impulses in the subject which will be interpreted by the subject as the original sound input, or at least something reasonably representative of the original sound input.

At least some of the components of the hearing system of the present invention are disposed within a shell or housing that is placed within the subject's auditory ear canal. Typically, the shell has one or more openings on both a first end and a second end so as to provide an open ear canal and to allow ambient sound (such as low and high frequency three dimensional localization cues) to be directly delivered to the tympanic membrane at a high level. Advantageously, the openings in the shell do not block the auditory canal and minimize interference with the normal pressurization of the ear. In some embodiments, the shell houses the input transducer, the transmitter assembly, and a battery. In other embodiments, portions of the transmitter assembly and the battery may be placed behind the ear (BTE), while the input transducer is positioned in the shell.

In the case of hearing aids, the input transducer assembly typically comprises a microphone in the housing that is disposed within the auditory ear canal. Suitable microphones are well known in the hearing aid industry and amply described in the patent and technical literature. The microphones will typically produce an electrical output is received by the transmitter assembly which in turn will produce the processed signal. In the case of ear pieces and other hearing systems, the sound input to the input transducer assembly will typically be electronic, such as from a telephone, cell phone, a portable entertainment unit, or the like. In such cases, the input transducer assembly will typically have a suitable amplifier or other electronic interface which receives the electronic sound input and which produces a filtered electronic output suitable for driving the output transducer assembly.

While it is possible to position the microphone behind the pinna, in the temple piece of eyeglasses, or elsewhere on the subject, it is preferable to position the microphone within the ear canal so that the microphone receives and transmits the higher frequency signals that are directed into the ear canal and to thus improve the final SRT.

The transmitter assembly of the present invention typically comprises a digital signal processor that processes the electrical signal from the input transducer and delivers a signal to a transmitter element that produces the processed output signal that actuates the output transducer. The digital signal processor will often have a filter that has a frequency response bandwidth that is typically greater than 6 kHz, more preferably between about 6 kHz and about 20 kHz, and most preferably between about 7 kHz and 13 kHz. Such a transmitter assembly differs from conventional transmitters found in that the higher bandwidth results in greater preservation of spatial localization cues for microphones that are placed at the entrance of the car canal or within the car canal.

In one embodiment, the transmitter element that is in communication with the digital signal processor is in the form of a coil that has an open interior and a core sized to fit within the open interior of the coil. A power source is coupled to the coil to supply a current to the coil. The current delivered to the coil will substantially correspond to the electrical signal processed by the digital signal processor. One useful electromagnetic-based assembly is described in commonly owned, copending U.S. patent application Ser. No. 10/902,660, filed Jul. 28, 2004, and entitled "Improved Transducer for Electromagnetic Hearing Devices," the complete disclosure of which is incorporated herein by reference.

The output transducer assembly of the present invention may be any component that is able to receive the processed signal from the transmitter assembly. The output transducer assembly will typically be configured to couple to some point in the hearing transduction pathway of the subject in order to induce neural impulses which are interpreted as sound by the subject. Typically, a portion of the output transducer assembly will couple to the tympanic membrane, a bone in the ossicular chain, or directly to the cochlea where it is positioned to vibrate fluid within the cochlea. Specific points of attachment are described in prior U.S. Pat. Nos. 5,259,032; 5,456,654; 6,084,975; and 6,629,922, the full disclosures of which have been incorporated herein by reference.

In one embodiment, the present invention provides a hearing system that has an input transducer that is positionable within an ear canal of a user to capture ambient sound that enters the ear canal of the user. A transmitter assembly receives electrical signals from the input transducer. The transmitter assembly comprises a signal processor that has a frequency response bandwidth in a 6.0 kHz to 20 kHz range. The transmitter assembly is configured to deliver filtered signals to an output transducer positioned in a middle or inner ear of the user, wherein the filtered signal is representative of the ambient sound received by the input transducer. A configuration of the input transducer and transmitter assembly provides an open ear canal that allows ambient sound to directly reach the middle ear of the user.

In another embodiment, the present invention provides a method. The method comprises positioning an input transducer within an ear canal of a user and transmitting signals from the input transducer that are indicative of ambient sound received by the input transducer to a transmitter assembly. The signals are processed (e.g., filtered) at the transmitter assembly with a signal processor that has a filter that has a bandwidth that is larger than about 6.0 kHz. The filtered signals are delivered to a middle ear or inner ear of the user. The positioning of the input transducer and transmitter assembly provides an open ear canal that allows non-filtered ambient sound to directly reach the middle ear of the user.

As noted above, in preferred embodiments, the signal processor has a bandwidth between about 6 kHz and about 20 kHz, so as to allow for preservation and transmission of the high frequency spatial localization cues.

While the remaining discussion will focus on the use of an electromagnetic transmitter assembly and output transducer, it should be appreciated that the present invention is not limited to such transmitter assemblies, and various other types of transmitter assemblies may be used with the present invention. For example, the photo-mechanical hearing transduction assembly described in co-pending and commonly owned, U.S. Provisional Patent Application Ser. No. 60/618,408, filed Oct. 12, 2004, entitled "Systems and Methods for Photo-mechanical Hearing Transduction," the complete disclosure of which is incorporated herein by reference, may be used with the hearing systems of the present invention. Furthermore, other transmitter assemblies, such as optical transmitters, ultrasound transmitters, infrared transmitters, acoustical transmitters, or fluid pressure transmitters, or the like may take advantage of the principles of the present invention.

The above aspects and other aspects of the present invention may be more fully understood from the following detailed description, taken together with the accompanying drawings.

DETAILED DESCRIPTION OF THE INVENTION

Figure 1:
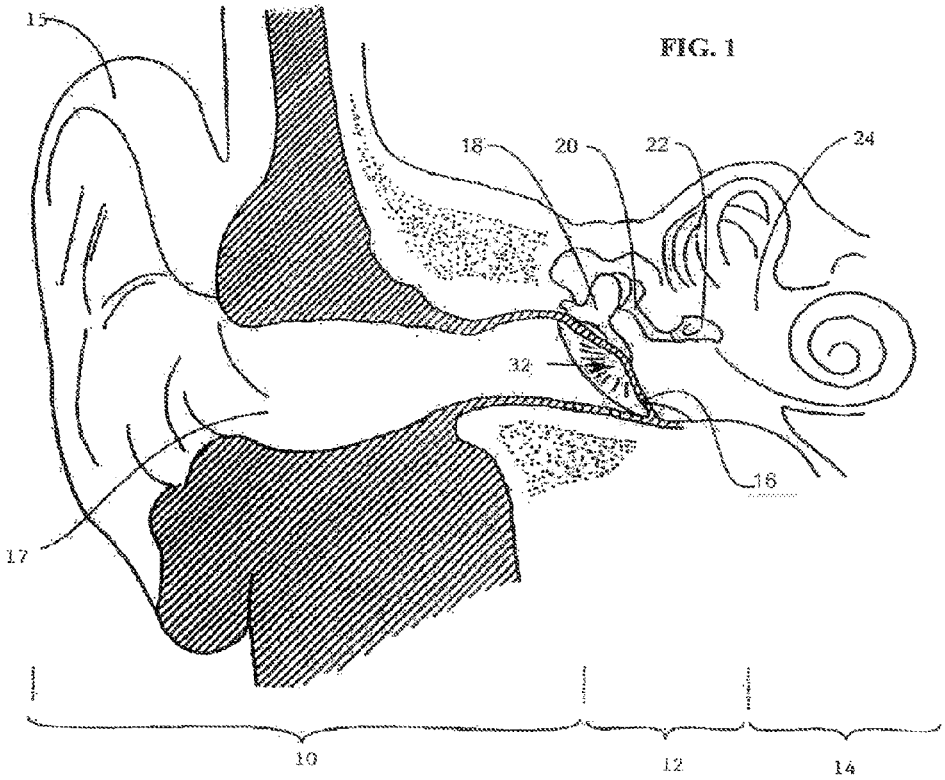
FIG. 1 is a cross-sectional view of a human ear, including an outer ear, middle ear, and part of an inner ear.

Referring now to FIG. 1, there is shown a cross sectional view of an outer ear 10, middle ear 12 and a portion of an inner ear 14. The outer ear 10 comprises primarily of the pima 15 and the auditory ear canal 17. The middle ear 12 is bounded by the tympanic membrane (ear drum) 16 on one side, and contains a series of three tiny interconnected bones: the malleus (hammer) 18; the incus (anvil) 20; and the stapes (stirrup) 22. Collectively, these three bones are known as the ossicles or the ossicular chain. The malleus 18 is attached to the tympanic membrane 16 while the stapes 22, the last bone in the ossicular chain, is coupled to the cochlea 24 of the inner ear.

In normal hearing, sound waves that travel via the outer ear or auditory ear canal 17 strike the tympanic membrane 16 and cause it to vibrate. The malleus 18, being connected to the tympanic membrane 16, is thus also set into motion, along with the incus 20 and the stapes 22. These three bones in the ossicular chain act as a set of impedance matching levers of the tiny mechanical vibrations received by the tympanic membrane. The tympanic membrane 16 and the bones may act as a transmission line system to maximize the bandwidth of the hearing apparatus (Puria and Allen, 1998). The stapes vibrates in turn causing fluid pressure in the vestibule of a spiral structure known as the cochlea 24 (Puria et al. 1997). The fluid pressure results in a traveling wave along the longitudinal axis of the basilar membrane (not shown). The organ of Corti sits atop the basilar membrane which contains the sensory epithelium consisting of one row of inner hair cells and three rows of outer hair cells. The inner-hair cells (not shown) in the cochlea are stimulated by the movement of the basilar membrane. There, hydraulic pressure displaces the inner ear fluid and mechanical energy in the hair cells is transformed into electrical impulses, which are transmitted to neural pathways and the hearing center of the brain (temporal lobe), resulting in the perception of sound. The outer hair cells are believed to amplify and compress the input to the inner hair cells. When there is sensory-neural hearing loss, the outer hair cells are typically damaged, thus reducing the input to the inner hair cells which results in a reduction in the perception of sound. Amplification by a hearing system may fully or partially restore the otherwise normal amplification and compression provided by the outer hair cells.

Figure 2:
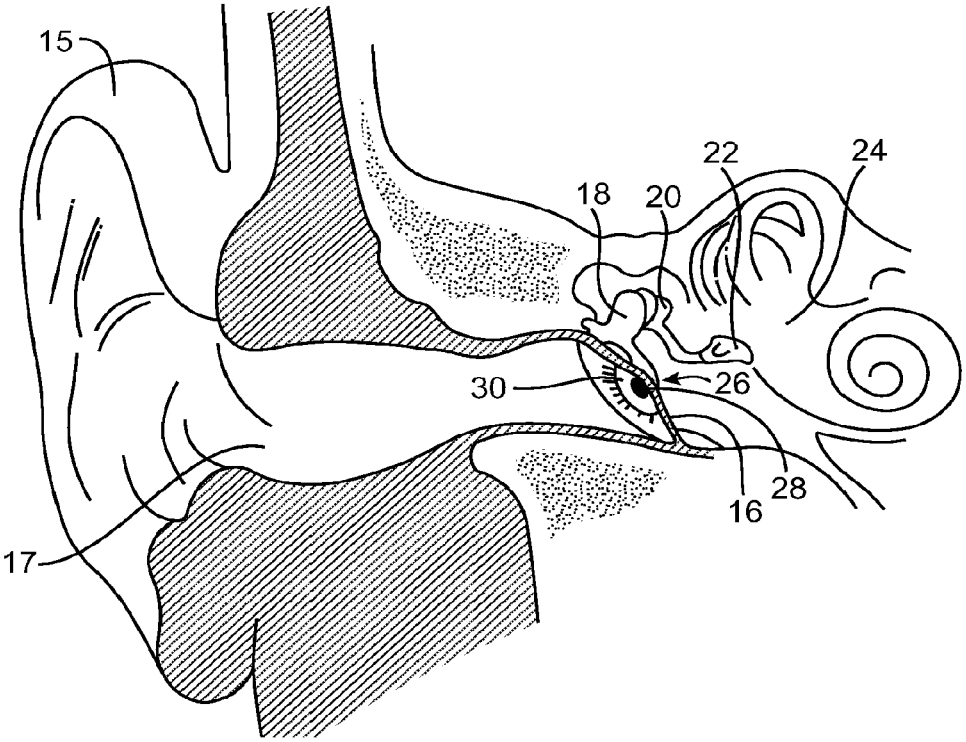
FIG. 2 illustrates an embodiment of the present invention with a transducer coupled to a tympanic membrane.

A presently preferred coupling point of the output transducer assembly is on the outer surface of the tympanic membrane 16 and is illustrated in FIG. 2. In the illustrated embodiment, the output transducer assembly 26 comprises a transducer 28 that is placed in contact with an exterior surface of the tympanic membrane 10. The transducer 28 generally comprises a high-energy permanent magnet. A preferred method of positioning the transducer is to employ a contact transducer assembly that includes transducer 28 and a support assembly 30. Support assembly 30 is attached to, or floating on, a portion of the tympanic membrane 16. The support assembly is a biocompatible structure with a surface area sufficient to support the transducer 28, and is vibrationally coupled to the tympanic membrane 16.

Preferably, the surface of support assembly 30 that is attached to the tympanic membrane substantially conforms to the shape of the corresponding surface of the tympanic membrane, particularly the umbo area 32. In one embodiment, the support assembly 30 is a conically shaped film in which the transducer is embedded therein. In such embodiments, the film is releasably contacted with a surface of the tympanic membrane. Alternatively, a surface wetting agent, such as mineral oil, is preferably used to enhance the ability of support assembly 30 to form a weak but sufficient attachment to the tympanic membrane 16 through surface adhesion. One suitable contact transducer assembly is described in U.S. Pat. No. 5,259,032, which was previously incorporated herein by reference.

Figure 3A:
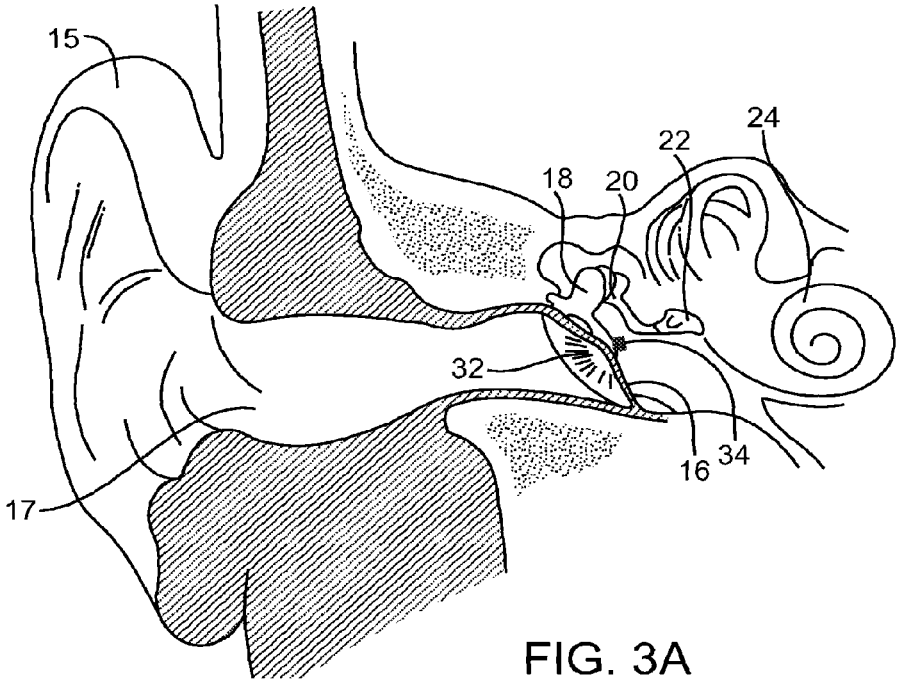
FIGS. 3A and 3B illustrate alternative embodiments of the transducer coupled to a malleus.
Figure 3B:
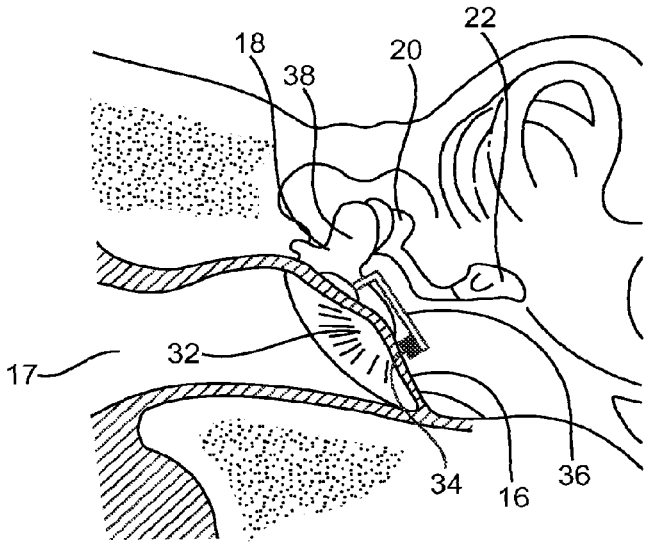

FIGS. 3A and 3B illustrate alternative embodiments wherein a transducer is placed on the malleus of an individual. In FIG. 3A, a transducer magnet 40 is attached to the medial side of the inferior manubrium. Preferably, magnet 40 is encased in titanium or other biocompatible material. By way of illustration, one method of attaching magnet 40 to the malleus is disclosed in U.S. Pat. No. 6,084,975, previously incorporated herein by reference, wherein magnet 40 is attached to the medial surface of the manubrium 44 of the malleus 18 by making an incision in the posterior periosteum of the lower manubrium, and elevating the periosteum from the manubrium, thus creating a pocket between the lateral surface of the manubrium and the tympanic membrane 10. One prong of a stainless steel clip device may be placed into the pocket, with the transducer magnet 34 attached thereto. The interior of the clip is of appropriate dimension such that the clip now holds onto the manubrium placing the magnet on its medial surface.

Alternatively, FIG. 3B illustrates an embodiment wherein clip 36 is secured around the neck of the malleus 18, in between the manubrium and the head 38 of the malleus. In this embodiment, the clip 36 extends to provide a platform of orienting the transducer magnet 34 toward the tympanic membrane 16 and ear canal 17 such that the transducer magnet 34 is in a substantially optimal position to receive signals from the transmitter assembly.

Figure 4A:
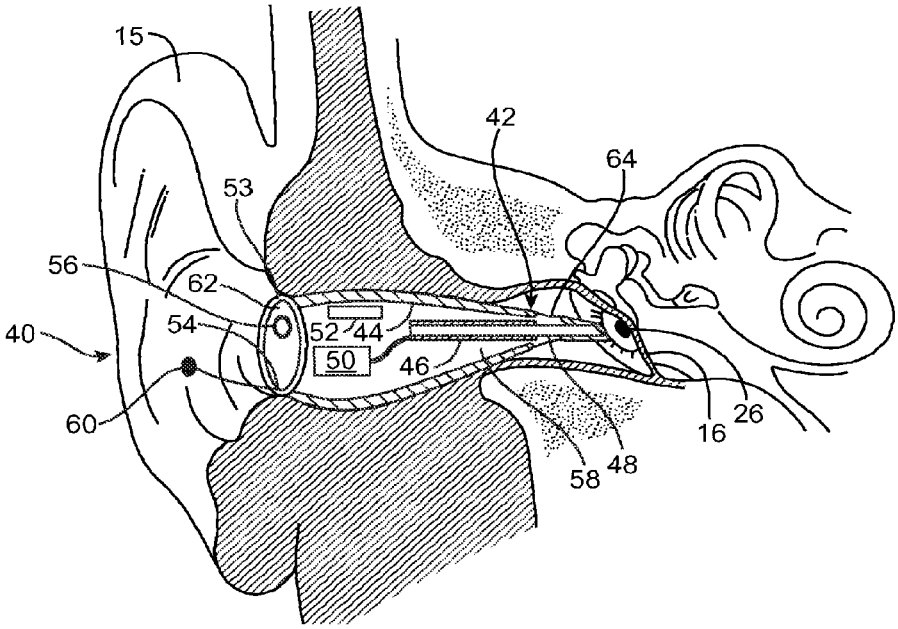
FIG. 4A schematically illustrates a hearing system of the present invention that provides an open ear canal so as to allow ambient sound/acoustic signals to directly reach the tympanic membrane.

FIG. 4A illustrates one preferred embodiment of a hearing system 40 encompassed by the present invention. The hearing system 40 comprises the transmitter assembly 42 (illustrated with shell 44 cross-sectioned for clarity) that is installed in a right ear canal and oriented with respect to the magnetic transducer 28 on the tympanic membrane 16. In the preferred embodiment of the current invention, the transducer 28 is positioned against tympanic membrane 16 at umbo area 32. The transducer may also be placed on other acoustic members of the middle ear, including locations on the malleus 18 (shown in FIGS. 3A and 3B), incus 20, and stapes 22. When placed in the umbo area 32 of the tympanic membrane 16, the transducer 28 will be naturally tilted with respect to the ear canal 17. The degree of tilt will vary from individual to individual, but is typically at about a 60-degree angle with respect to the ear canal.

The transmitter assembly 42 has a shell 44 configured to mate with the characteristics of the individual's ear canal wall. Shell 44 is preferably matched to fit snug in the individual's ear canal so that the transmitter assembly 42 may repeatedly be inserted or removed from the ear canal and still be properly aligned when re-inserted in the individual's ear. In the illustrated embodiment, shell 44 is also configured to support a coil 46 and a core 48 such that the tip of core 48 is positioned at a proper distance and orientation in relation to the transducer 28 when the transmitter assembly 42 is properly installed in the ear canal 17. The core 48 generally comprises ferrite, but may be any material with high magnetic permeability.

In a preferred embodiment, coil 46 is wrapped around the circumference of the core 48 along part or all of the length of the core. Generally, the coil has a sufficient number of rotations to optimally drive an electromagnetic field toward the transducer 28. The number of rotations may vary depending on the diameter of the coil, the diameter of the core, the length of the core, and the overall acceptable diameter of the coil and core assembly based on the size of the individual's ear canal. Generally, the force applied by the magnetic field on the magnet will increase, and therefore increase the efficiency of the system, with an increase in the diameter of the core. These parameters will be constrained, however, by the anatomical limitations of the individual's ear. The coil 46 may be wrapped around only a portion of the length of the core, as shown in FIG. 4A, allowing the tip of the core to extend further into the ear canal 17, which generally converges as it reaches the tympanic membrane 16.

One method for matching the shell 44 to the internal dimensions of the ear canal is to make an impression of the ear canal cavity, including the tympanic membrane. A positive investment is then made from the negative impression. The outer surface of the shell is then formed from the positive investment which replicated the external surface of the impression. The coil 46 and core 48 assembly can then be positioned and mounted in the shell 44 according to the desired orientation with respect to the projected placement of the transducer 28, which may be determined from the positive investment of the ear canal and tympanic membrane. In an alternative embodiment, the transmitter assembly 42 may also incorporate a mounting platform (not shown) with micro-adjustment capability for orienting the coil and core assembly such that the core can be oriented and positioned with respect to the shell and/or the coil. In another alternative embodiment, a CT, MRI or optical scan may be performed on the individual to generate a 3D model of the ear canal and the tympanic membrane. The digital 3D model representation may then be used to form the outside surface of the shell 44 and mount the core and coil.

As shown in the embodiment of FIG. 4A, transmitter assembly 42 may also comprise a digital signal processing (DSP) unit and other components 50 and a battery 52 that are placed inside shell 44. The proximal end 53 of the shell 44 is open 54 and has the input transducer (microphone) 56 positioned on the shell so as to directly receive the ambient sound that enters the auditory ear canal 17. The open chamber 58 provides access to the shell 44 and transmitter assembly 42 components contained therein. A pull line 60 may also be incorporated into the shell 44 so that the transmitter assembly can be readily removed from the ear canal.

Advantageously, in many embodiments, an acoustic opening 62 of the shell allows ambient sound to enter the open chamber 58 of the shell. This allows ambient sound to travel through the open volume 58 along the internal compartment of the transmitter assembly 42 and through one or more openings 64 at the distal end of the shell 44. Thus, ambient sound waves may reach and directly vibrate the tympanic membrane 16 and separately impart vibration on the tympanic membrane. This open-channel design provides a number of substantial benefits. First, the open channel 17 minimizes the occlusive effect prevalent in many acoustic hearing systems from blocking the ear canal. Second, the open channel allows the high frequency spatial localization cues to be directly transmitted to the tympanic membrane 17. Third, the natural ambient sound entering the ear canal 16 allows the electromagnetically driven effective sound level output to be limited or cut off at a much lower level than with a hearing system that blocks the ear canal 17. Finally, having a fully open shell preserves the natural pinna diffraction cues of the subject and thus little to no acclimatization, as described by Hoffman et al. (1998), is required.

Figure 5:
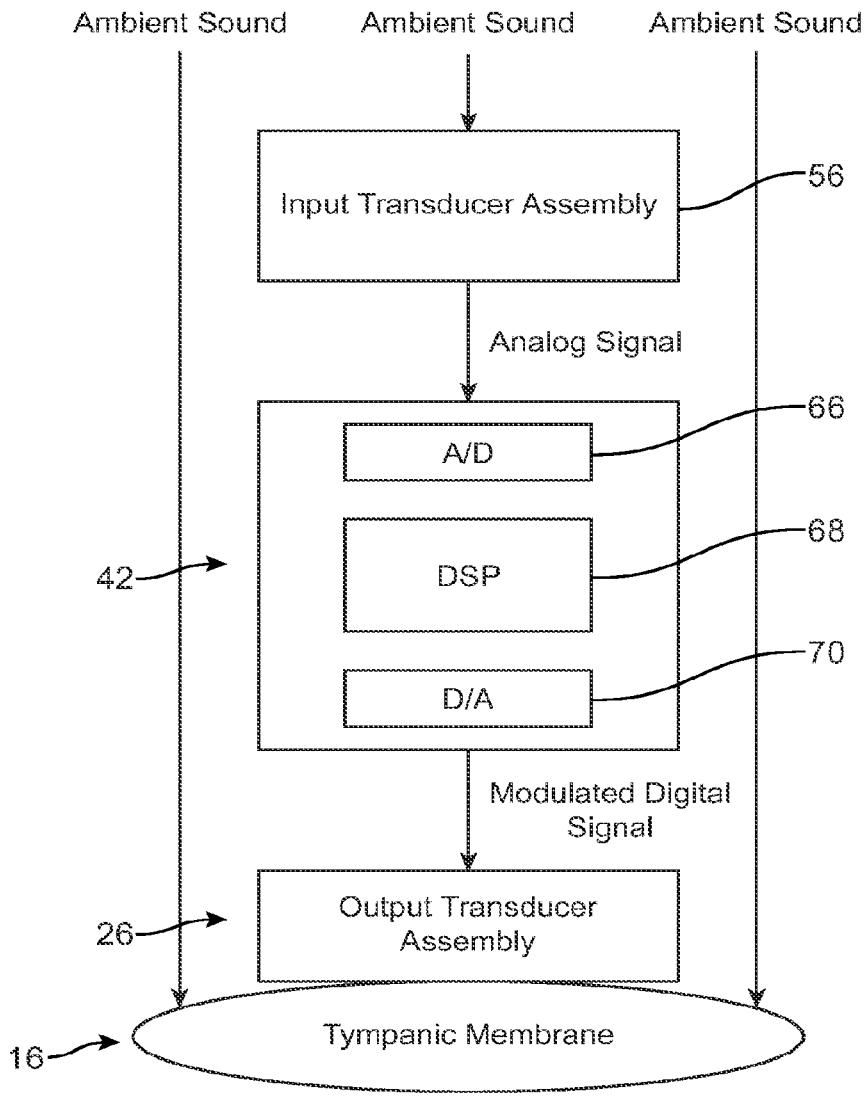
FIG. 5 schematically illustrates a hearing system embodied by the present invention.

As shown schematically in FIG. 5, in operation, ambient sound entering the auricle and car canal 17 is captured by the microphone 56 that is positioned within the open ear canal 17. The microphone 56 converts sound waves into analog electrical signals for processing by a DSP unit 68 of the transmitter assembly 42. The DSP unit 68 may optionally be coupled to an input amplifier (not shown) to amplify the electrical signal. The DSP unit 68 typically includes an analog-to-digital converter 66 that converts the analog electrical signal to a digital signal. The digital signal is then processed by any number of digital signal processors and filters 68. The processing may comprise of any combination of frequency filters, multi-band compression, noise suppression and noise reduction algorithms. The digitally processed signal is then converted back to analog signal with a digital-to-analog converter 70. The analog signal is shaped and amplified and sent to the coil 46, which generates a modulated electromagnetic field containing audio information representative of the original audio signal and, along with the core 48, directs the electromagnetic field toward the transducer magnet 28. The transducer magnet 28 vibrates in response to the electromagnetic field, thereby vibrating the middle-ear acoustic member to which it is coupled (e.g. the tympanic membrane 16 in FIG. 4A or the malleus 18 in FIGS. 3A and 3B).

In one preferred embodiment, the transmitter assembly 42 comprises a filter that has a frequency response bandwidth that is typically greater than 6 kHz, more preferably between about 6 kHz and about 20 kHz, and most preferably between about 6 kHz and 13 kHz. Such a transmitter assembly 42 differs from conventional transmitters found in conventional hearing aids in that the higher bandwidth results in greater preservation of spatial localization cues for microphones 56 that are placed at the entrance of the auditory ear canal or within the ear canal 17. The positioning of the microphone 56 and the higher bandwidth filter results in a speech reception threshold improvement of up to 5 dB above existing hearing systems where there are interfering speech sources. Such a significant improvement in SRT, due to central mechanisms, is not possible with existing hearing aids with limited bandwidth, limited gain and sound processing without pinna diffraction cues.

For most hearing-impaired subjects, sound reproduction at higher decibel ranges is not necessary because their natural hearing mechanisms are still capable of receiving sound in that range. To those familiar in the art, this is commonly referred to as the recruitment phenomena where the loudness perception of a hearing impaired subject "catches up" with the loudness perception of a normal hearing person at loud sounds (Moore, 1998). Thus, the open-channel device may be configured to switch off, or saturate, at levels where natural acoustic hearing takes over. This can greatly reduce the currents required to drive the transmitter assembly, allowing for smaller batteries and/or longer battery life. A large opening is not possible in acoustic hearing aids because of the increase in feedback and thus limiting the functional gain of the device. In the electromagnetically driven devices of the present invention, acoustic feedback is significantly reduced because the tympanic membrane is directly vibrated. This direct vibration ultimately results in generation of sound in the ear canal because the tympanic membrane acts as a loudspeaker cone. However, the level of generated acoustic energy is significantly less than in conventional hearing aids that generate direct acoustic energy in the ear canal. This results in much greater functional gain for the open ear canal electromagnetic transmitter and transducer than with conventional acoustic hearing aids.

Because the input transducer (e.g., microphone) is positioned in the ear canal, the microphone is able to receive and retransmit the high-frequency three dimensional spatial cues. If the microphone was not positioned within the auditory ear canal, (for example, if the microphone is placed behind-the ear (BTE)), then the signal reaching its microphone does not carry the spatially dependent pinna cues. Thus there is little chance for there to be spatial information.

Figure 4B:
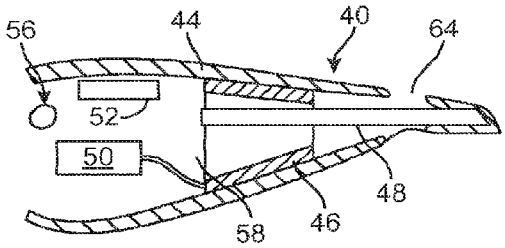
FIG. 4B illustrates an alternative embodiment of the hearing system of the present invention with the coil laid along an inner wall of the shell.

FIG. 4B illustrates an alternative embodiment of a transmitter assembly 42 wherein the microphone 56 is positioned near the opening of the ear canal on shell 44 and the coil 46 is laid on the inner walls of the shell 44. The core 62 is positioned within the inner diameter of the coil 46 and may be attached to either the shell 44 or the coil 46. In this embodiment, ambient sound may still enter ear canal and pass through the open chamber 58 and out the ports 68 to directly vibrate the tympanic membrane 16.

Figure 6A:
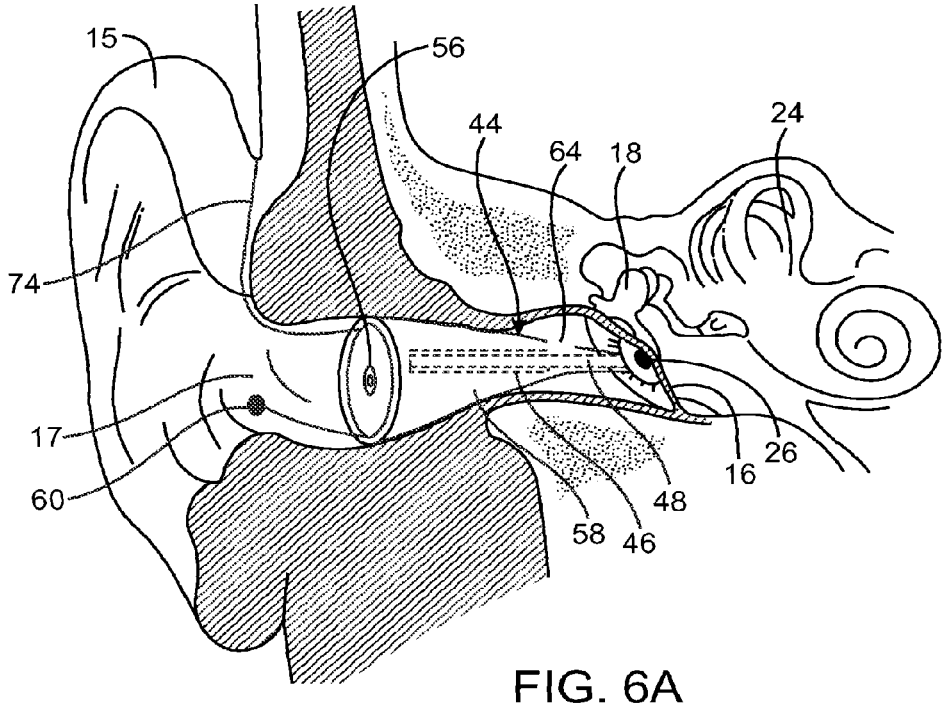
FIG. 6A illustrates a hearing system embodiment having a microphone (input transducer) positioned on an inner surface of a canal shell and a transmitter assembly positioned in an ear canal that is in communication with the transducer that is coupled to the tympanic membrane.
Figure 6B:
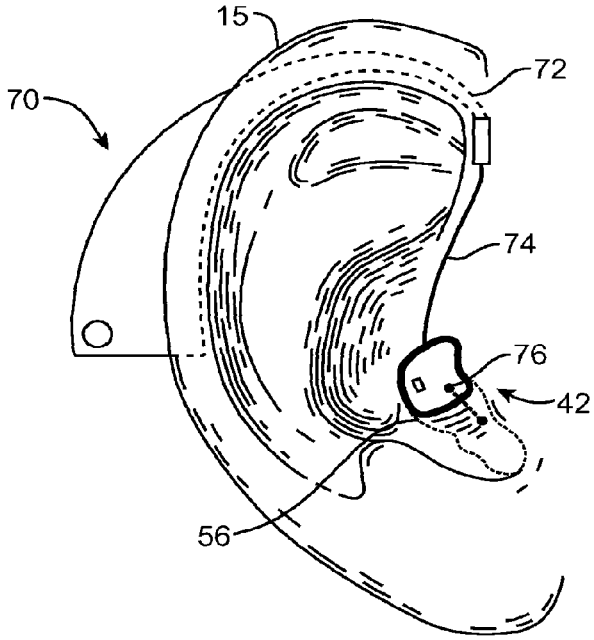
FIG. 6B illustrates an alternative medial view of the present invention with a microphone in the canal shell wall near the entrance.

Now referring to FIGS. 6A and 6B, an alternative embodiment is illustrated wherein one or more of the DSP unit 50 and battery 52 are located external to the auditory ear canal in a driver unit 70. Driver unit 70 may hook on to the top end of the pinna 15 via ear hook 72. This configuration provides additional clearance for the open chamber 58 of shell 44 (FIG. 4B), and also allows for inclusion of components that would not otherwise fit in the ear canal of the individual. In such embodiments, it is still preferable to have the microphone 56 located in or at the opening of the ear canal 17 to gain benefit of high bandwidth spatial localization cues from the auricle 17. As shown in FIGS. 6A and 6B, sound entering the ear canal 17 is captured by microphone 56. The signal is then sent to the DSP unit 50 located in the driver unit 70 for processing via an input wire in cable 74 connected to jack 76 in shell 44. Once the signal is processed by the DSP unit 50, the signal is delivered to the coil 46 by an output wire passing back through cable 74.

Figure 7:
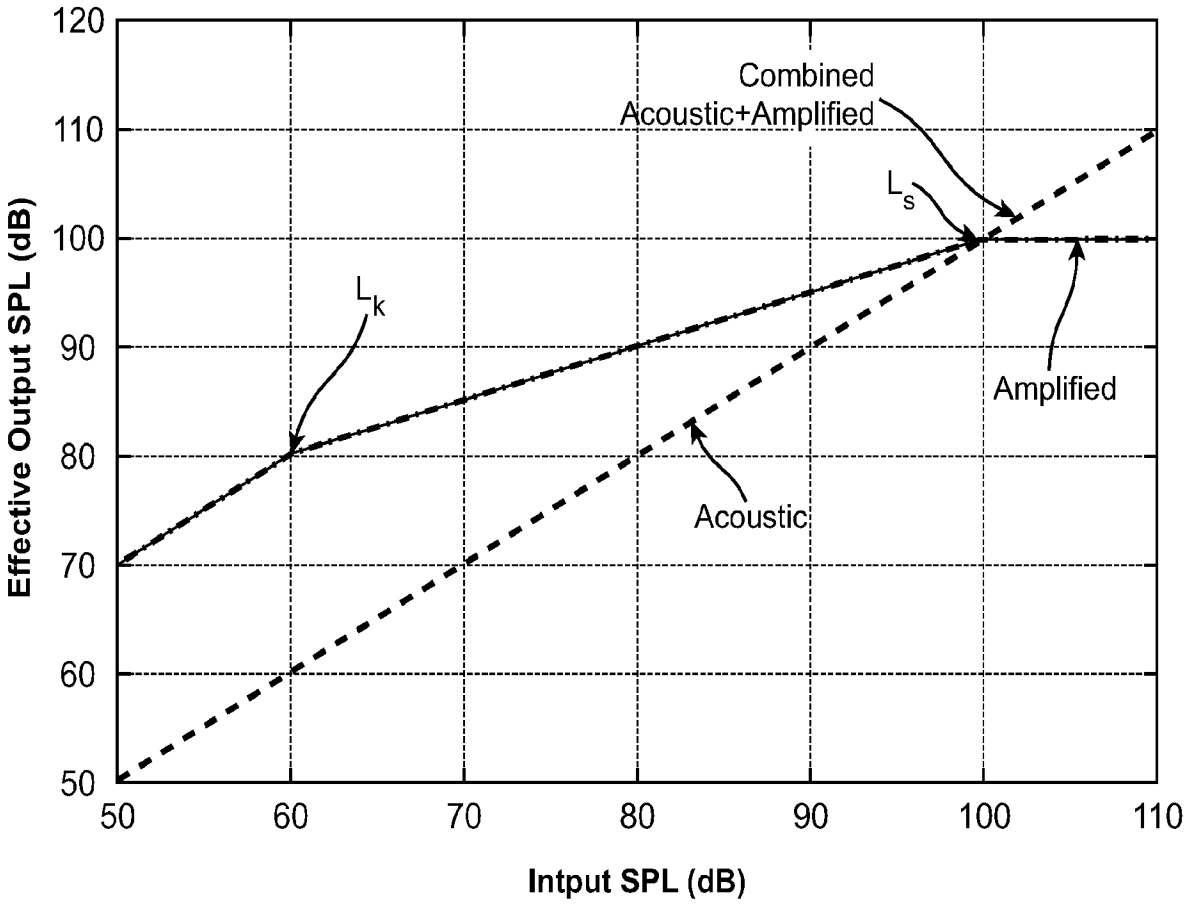
FIG. 7 is a graph that illustrates an acoustic signal that reaches the ear drum and the effective amplified signal at the eardrum and the combined effect of the two.

FIG. 7 is a graph that illustrates the effective output sound pressure level (SPL) versus the input sound pressure level. As shown in the graph, since the hearing systems 40 of the present invention provide an open auditory ear canal 17, ambient sound is able to be directly transmitted through the auditory ear canal and directly onto the tympanic membrane 17. As shown in the graph, the line labeled "acoustic" shows the acoustic signal that directly reaches the tympanic membrane through the open ear canal. The line labeled "amplified" illustrates the signal that is directed to the tympanic membrane through the hearing system of the present invention. Below the input knee level $L_k$, the output increases linearly. Above input saturation level $L_s$, the amplified output signal is limited and no longer increases with increasing input level. Between input levels $L_k$ and $L_s$, the output may be compressed, as shown. The line labeled "Combined Acoustic+Amplified" illustrates the combined effect of both the acoustic signal and the amplified signal. Note that despite the fact that the output of the amplified system is saturated above $L_s$, the combined effect is that effective sound input continues to increase due to the acoustic input from the open canal.

The foregoing description of a preferred embodiment of the invention has been presented for purposes of illustration and description. It is not intended to be exhaustive or to limit the invention to the precise forms disclosed. Obviously, many modifications and variations will be apparent to practitioners skilled in this art. It is intended that the scope of the invention be defined by the following claims and their equivalents.

What is claimed is:

1. A hearing system comprising:

an input transducer configured to capture ambient sound, including high frequency localization cues, and convert the captured sound into electrical signals; and a transmitter assembly configured to receive the electrical signals from the input transducer, the transmitter assembly comprising a signal processor that is configured to generate filtered signals from the received electrical signals, the transmitter assembly comprising a transmitter and a transmission element, the transmitter assembly configured to deliver both power and filtered signals from the transmitter through a tip of the transmission element to produce mechanical vibrations with an output transducer configured to be positioned on a tympanic membrane of a user, the filtered signals being representative of the ambient sound received by the input transducer;

wherein the transmitter assembly is positionable at least partially behind a pinna of the user to provide an open canal to allow the ambient sound to pass through the open canal and bypass the transmitter assembly to directly reach the tympanic membrane of the user;

wherein the signal processor is configured to amplify the filtered signals that comprise the high frequency localization cues when the magnitude of the filtered signals is below a saturation level;

wherein the transmitter assembly is configured to decrease current to the signal processor when the magnitude of the filtered signals is above the saturation level;

wherein the ambient sound passing through the open canal provides greater equivalent sound pressure to the eardrum than the equivalent sound pressure of the output transducer when the magnitude of the filtered signals is above the saturation level, and wherein the transmitter assembly comprises a shell configured to conform to an inner wall surface of the ear canal, the shell being configured for placement at least partially in the ear canal.

2. The hearing system of claim 1, wherein the input transducer comprises a microphone to capture the ambient sound.

3. The hearing system of claim 2, wherein the microphone is configured to be positioned in or at the opening of the ear canal of the user when the transmitter assembly is positioned at least partially behind the pinna.

4. The hearing system of claim 1, wherein the tip of the transmission element is positioned at a substantially the same distance and orientation relative to the output transducer when the transmitter assembly is positioned, removed, and repositioned within the ear canal.

5. The hearing system of claim 1, wherein the transmitter assembly comprises an optical transmitter.

* * * * *